US008292729B2

(12) United States Patent
Vlazny et al.

(10) Patent No.: US 8,292,729 B2
(45) Date of Patent: Oct. 23, 2012

(54) METHODS AND SYSTEMS FOR PRESENTING PARI-MUTUEL BETTING OPTIONS AND CONSTRUCTING WAGERS

(75) Inventors: Kenneth A. Vlazny, York, PA (US); Scott B. Pfennighausen, San Diego, CA (US); Stephen M. Smith, Shrewsbury, PA (US); Joseph J. Tracy, Westminster, MD (US); Victor I. Harrison, Glen Rock, PA (US)

(73) Assignee: United Tote Company, Louisville, KY (US)

( * ) Notice: Subject to any disclaimer, the term of this patent is extended or adjusted under 35 U.S.C. 154(b) by 1124 days.

(21) Appl. No.: 10/727,154

(22) Filed: Dec. 2, 2003

(65) Prior Publication Data

US 2005/0116410 A1 Jun. 2, 2005

(51) Int. Cl.
*A63F 9/24* (2006.01)

(52) U.S. Cl. ..... 463/25; 463/42; 700/91; 700/93

(58) Field of Classification Search ..... 463/40–42; 700/91–93

See application file for complete search history.

(56) References Cited

U.S. PATENT DOCUMENTS

| | | | |
|---|---|---|---|
| 3,909,002 | A | 9/1975 | Levy |
| 4,322,612 | A | 3/1982 | Lange |
| 4,669,730 | A | 6/1987 | Small |
| 5,038,022 | A | 8/1991 | Lucero |
| 5,265,874 | A | 11/1993 | Dickinson et al. |
| 5,457,306 | A | 10/1995 | Lucero |
| 5,557,086 | A | 9/1996 | Schulze et al. |
| 5,559,312 | A | 9/1996 | Lucero |
| 5,564,977 | A | 10/1996 | Algie |
| 5,779,547 | A | 7/1998 | SoRelle et al. |

(Continued)

FOREIGN PATENT DOCUMENTS

| | | |
|---|---|---|
| WO | WO 00/67215 | 11/2000 |

(Continued)

OTHER PUBLICATIONS

International Search Report for PCT/US2004/040060 dated Mar. 28, 2008, 1 page.

(Continued)

*Primary Examiner* — Dmitry Suhol
*Assistant Examiner* — Alex F. R. P. Rada, II
(74) *Attorney, Agent, or Firm* — TraskBritt

(57) ABSTRACT

Methods and systems of pari-mutuel wagering are disclosed to facilitate the wager construction process. In one method, patrons select runners, and betting options of selected runners are presented. In another method, a first wager is placed and other wagers are presented, wherein the additional wagers may include a runner of the first wager. Another method allows patrons to wager on a runner, wherein an area representing the runner is marked to indicate that this runner was selected on a previous wager or in the current wager. In another method, a portion of a wager is patron selected and a portion of the wager is suggested by the betting interface. In another method, patrons may construct wager(s) for single or future races, or specify criteria for those wagers. In another method, runners are displayed in a table and patrons may select or deselect runner combinations by selecting cells within the table. Methods and systems of pari-mutuel wagering that enable an organization to set rules to display the gaming activity, and an embodiment where players make subscription as well as programmed bets are described.

12 Claims, 25 Drawing Sheets

U.S. PATENT DOCUMENTS

| | | | | |
|---|---|---|---|---|
| 5,800,268 | A | 9/1998 | Milnick | |
| 5,806,045 | A | 9/1998 | Biorge et al. | |
| 5,952,640 | A | 9/1999 | Lucero | |
| 6,004,211 | A | 12/1999 | Brenner et al. | |
| 6,033,308 | A | 3/2000 | Orford et al. | |
| 6,190,256 | B1 | 2/2001 | Walker et al. | |
| 6,309,307 | B1 | 10/2001 | Krause et al. | |
| 6,331,148 | B1 | 12/2001 | Krause et al. | |
| 6,358,150 | B1 | 3/2002 | Mir et al. | |
| 6,394,907 | B1 | 5/2002 | Rowe | |
| 6,450,887 | B1 | 9/2002 | Mir et al. | |
| 6,511,377 | B1 | 1/2003 | Weiss | |
| 6,554,709 | B1 | 4/2003 | Brenner et al. | |
| 6,722,980 | B2 | 4/2004 | Stronach | |
| 2001/0031656 | A1 | 10/2001 | Marshall et al. | |
| 2001/0051540 | A1* | 12/2001 | Hindman et al. | 463/25 |
| 2002/0065566 | A1 | 5/2002 | Aronson et al. | |
| 2002/0177483 | A1 | 11/2002 | Cannon | |
| 2003/0078094 | A1 | 4/2003 | Gatto et al. | |
| 2003/0119582 | A1 | 6/2003 | Ocampo | |
| 2003/0125822 | A1* | 7/2003 | LaNeve | 700/91 |
| 2004/0111358 | A1 | 6/2004 | Lange et al. | |
| 2004/0229671 | A1 | 11/2004 | Stronach et al. | |
| 2005/0130735 | A1 | 6/2005 | Ellis | |

FOREIGN PATENT DOCUMENTS

| | | |
|---|---|---|
| WO | 01/00182 | 8/2001 |

OTHER PUBLICATIONS

Written Opinion of the International Searching Authority for PCT/US2004/040060, dated Mar. 28, 2008, 6 pages.

* cited by examiner

YORK OTW 7 900D-B33D-8BB3

5-NOV-02 105

Race 4 AQUEDUCT $2 QUINELLA $2

1 WITH 6

$1 WIN $1

4

$1 PLACE $1

7

$1 TRIFECTA $1

1 WITH 6 WITH 3

4 BETS, TOTAL $5

SAM

5Nov02 W003209 13:52:42

7 900D-B33D-8BB3

City _____ State _____ Zip _____

Telephone (h) _____ (w) _____

Signature _____

How to play.

Pick your six numbers as usual. Six numbers are drawn from 1 to 42 - if you match all six, you win the jackpot just like always! Then, we draw a bonus number from the remaining 36 numbers. And that's your chance to win lots of other prizes - up to $10,000!

| | | | | | | |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | 32 | 33 | 34 | 35 |
| 36 | 37 | 38 | 39 | 40 | 41 | 42 |

Allow 2 to 3 weeks for processing.

*FIG. 17*
*(PRIOR ART)*

102

100

| | | | | | | |
|---|---|---|---|---|---|---|
| 1 | 5.5 | Scrimshaw<br>Escobar, Victor 126 lbs. | 1 | 1 | 1 | 1 |
| 1A | | Senor Swinger<br>Pat Day 126 lbs. | | | | |
| 2 | 10.0 | Cherokee's Boy<br>Jimmy Coates 126 lbs. | 2 | 2 | 2 | 2 |
| 3 | 21.9 | Fuofa's Warrior<br>Josh Boyd 126 lbs. | 3 | 3 | 3 | 3 |
| 4 | 10.5 | Kissin Saint<br>Nicky Madrid 126 lbs. | 4 | 4 | 4 | 4 |
| 5 | 8.8 | Ten Cents a Shine<br>Esgar Ramirex 126 lbs. | 5 | 5 | 5 | 5 |
| 6 | 19.7 | Midway Road<br>Adan Fuentes 126 lbs. | 6 | 6 | 6 | 6 |
| 7 | 3.4 | Peace Rules<br>Tommy Wales 126 lbs. | 7 | 7 | 7 | 7 |
| 8 | 19.1 | New York Hero<br>Alex O Solis 126 lbs. | 8 | 8 | 8 | 8 |
| 9 | 3.2 | Funny Cide<br>Jose Santos 126 lbs. | 9 | 9 | 9 | 9 |
| 10 | | | 10 | 10 | 10 | 10 |
| 11 | | | 11 | 11 | 11 | 11 |
| 12 | | | 12 | 12 | 12 | 12 |

104

FIG. 25

| Track Name | LeapFrogUp MTP | Area A Eligible | Area B Eligible | Area C Eligible |
|---|---|---|---|---|
| Arlington Park | 5 | ☑ | ☑ | ☑ |
| Belmont Park | 5 | ☐ | ☑ | ☑ |
| Churchill Downs | 10 | ☑ | ☑ | ☑ |
| Hollywood Park | 5 | ☑ | ☑ | ☑ |
| Calder Race Course | 5 | ☑ | ☐ | ☑ |
| Thistle/River Downs | 0 | ☐ | ☑ | ☑ |
| Monmouth | 0 | ☐ | ☑ | ☑ |
| Woodbine | 0 | ☐ | ☐ | ☑ |

METHODS AND SYSTEMS FOR PRESENTING PARI-MUTUEL BETTING OPTIONS AND CONSTRUCTING WAGERS

CROSS-REFERENCE TO RELATED APPLICATIONS

This application is related to copending U.S. patent application Ser. No. 11/001,578, filed Dec. 1, 2004, which case is a continuation-in-part of the present application.

BACKGROUND OF THE INVENTION

1. Field of the Invention

The invention relates generally to the field of gaming and, more particularly, to pari-mutuel betting methods, pari-mutuel gaming systems and electronic betting interfaces.

2. State of the Art

Pari-mutuel betting is a system of cooperative wagering where the holders of winning tickets divide the total amount of money bet on a pool of a race or other competitive event, after deductions for taxes and operator expenses are taken out of the pool. In pari-mutuel betting, the payoff odds are determined by the amount of money wagered and the amount of successful wagers. For instance, if the majority of money is wagered on the eventual winner, the payoff odds are lower since the winners split the pool. There can be multiple pools for any given wagering event. For example, a racing track may offer win, place, show, exacta, and trifecta pool wagers on each race. Each pool has different criteria for winning the money bet into it, and the expected payoff or "price" of the wager is typically greater with certain types of wagers that have few successful wagers, like trifecta, than with wagers for which there are frequently a lot of winners, like show pools. Pari-mutuel betting is typically offered at horseracing tracks, but it is also used at other types of racing tracks including greyhound tracks, as well as jai alai games.

Although pari-mutuel betting has been around for many years, the number of players or patrons participating in pari-mutuel betting has declined. One reason for the decline is the lack of new, and younger, participants in pari-mutuel gaming. The younger generation typically likes fast paced and exciting gaming activities and, when participants go to a track, the races on which the pari-mutuel bets are placed may only take place at certain intervals. Thus, if participants are only able to place a bet and see the race every half hour or so, the participants may lose interest.

One attempt to attract more participants to pari-mutuel betting is simulcasting. In simulcasting, races from multiple race tracks are broadcast at a betting facility, whereat participants are able to place bets on races occurring at the various race tracks. In this manner, the participants are able to place more bets and increase the entertainment value of the gaming experience for a given period of time.

Another barrier to recruiting new patrons is their relative disadvantage when competing with bettors who are adept at assessing or "handicapping" race participants. The handicapping process is a selection process developed by more experienced and sophisticated players that evaluates different factors of the race competitors and is used to influence the bet selections of these players. Learning the handicapping process of pari-mutuel betting can often be intimidating for new players. The acquisition of knowledge in handicapping and correct wager selection is time-consuming and, therefore, creates a barrier to participation for many new players.

Another important reason for constrained growth in pari-mutuel wagering is the complexity of placing wagers. Bettors can choose from a large number of available betting pools. These pools can cover a single race or multiple races. Single race pools include Win, Place, Show, Exacta (AKA Perfecta), Quinella, Trifecta (AKA Triple), and Superfecta. Multiple race pools include Daily Double, Pick 3, Pick 4, Pick 6, Quinella Double, Twin Trifecta, and Tri-super. The fact that there are so many bets to learn can be daunting to novices.

Some pools, generally referred to as "exotics," such as exacta, trifecta, and superfecta can be especially confusing. These bets require the bettor to correctly predict the finish order of each relevant runner. For example, in an exacta wager, the bettor must specify which runner will cross the finish line first and which runner will cross second. Therefore, in addition to selecting the pool and runners, bettors must determine which runners they would like to bet on for each position (for single race pools) or leg (for multiple race pools). Over time, a number of shortcuts have been developed to make it easier for bettors to cover their desired runners in each position. The totalisator industry refers to these shortcuts as "bet modifiers." There are four commonly used bet modifiers; "box"—in which the selected participants or runners are placed in all finish positions and/or legs, "wheel"—in which all participants are placed in a specified position and/or legs, "part wheel"—in which multiple participants (but not all) are placed in a specified position or leg and "key"—in which a single runner is specified in the first position or leg and other specified runners are automatically placed in all of the remaining positions or legs. Bet modifiers, while helpful shortcuts to experienced bettors, present yet another level of complexity for novice bettors.

Currently, there are essentially three mediums available for placing wagers: oral, printed bet slip, and electronic interface. The most traditional medium is the oral bet. In this medium, the patron makes his or her wager to a teller, who enters the wager into a computer terminal. Another common medium, especially popular outside of the United States, is for the bettor to complete a printed bet slip and input the slip into a computer or betting terminal. The third medium, the electronic interface, has grown in popularity over the past several years. "Self-service" terminals have been developed that allow a patron to enter his or her wager without a teller intermediary by selecting various interface areas on a computer touchscreen. In addition, patrons can use Internet betting sites or touch tone telephones to proceed through the betting process. The betting machines may be employed at racetracks, at offtrack betting sites (OTBs) and may be interfaced with other media such as the Internet. In both teller-operated and self-serve betting, the bet entry process is essentially linear. While the patron may be able to change a portion of his wager, the practice of data entry through electronic interfaces has been as follows: track name, race number, wager amount, pool/bet modifier, and runner selected. This sequence of data entry can often be cumbersome since pool types are selected prior to the selection of runners and this data entry sequence generally requires that a patron know which pool(s) he or she wishes to place wagers on prior to beginning the process of placing a wager. In addition, this sequence generally requires that a patron restate (to a teller), remark (on a bet slip), or reselect (on a touchscreen providing an electronic interface) desired runners for each of the pools on which he or she desires to wager. The requirement for reselecting runners exists even when placing multiple wagers (win, exacta, trifecta) on the same runners in the same race. For example, a bettor wishing to place trifecta box and exacta box bets on the 1, 2, and 3 horses generally needs to place the trifecta bet, select the exacta pool and reselect the 1, 2 and 3 runners for the exacta wager. This process is cumbersome, time-consuming and error-prone. In short, it provides another obstacle for increased participation in pari-mutuel wagering.

Three methods currently exist for placing wagers: single pool betting, multiple pool betting and multibet. The most common method for placing pari-mutuel wagers is single pool betting. In this method, the patron generally selects a track, race, wager amount, pool (win or place or show or exacta, or trifecta, etc.), optionally a pool modifier such as "box" or "wheel" (in some cases the patron may select the pool and modifier simultaneously by pressing an "exacta box" button, for example) and runners. In single pool betting, a patron who wants to place multiple wagers on a single race must reselect runners for each pool on which he or she desires to wager. Single pool betting is generally accomplished orally at teller-operated terminals, by bet slips fed into staffed terminals, or through electronic interfaces of self-serve terminals and computers. FIG. 1 illustrates a conventional ticket for pari-mutuel betting that includes four wagers, a Quinella, a Win, a Place and a Trifecta. For the patron to place the 1/6 Quinella bet and the 1/6/3 Trifecta bet, the patron must reselect the runners, regardless of the order in which the wagers were entered.

The second most common method of placing pari-mutuel wagers is multiple pool betting. In this method, the patron selects a wager amount, for example $2.00, a multiple wager pool, most commonly Win, Place and Show, and the desired runners. This method allows for rapid entry of multiple wagers of the same value on the same runners. However, multiple pool betting has limitations as it lacks flexibility in that, if the bettor wanted a $4 win bet and $2 place and show bets, he or she could not use this method and would have to enter the wagers by the single pool method. Multiple pool betting can be accomplished orally through teller-operated terminals, using bet slips or through electronic interfaces of self-service terminals and computers. A much less popular method for placing wagers is "MultiBet" currently offered by Playboy Racing USA of Grantville, Pa. The MultiBet is essentially a single pool bet with the option of accepting runner selections for up to sixteen runners in up to six positions, or legs, regardless of the actual number of runners and pools available. To place wagers into multiple pools, the patron selects each pool type, re-enters a wager amount and adds the wager to the cue for later submission by the patron. Playboy Racing describes MultiBet as follows: "MultiBet is a facility that makes placing bets over the Internet even faster and easier. It does this by allowing you to create a batch of bets over multiple tracks, races and bet types. This batch of bets is then submitted for processing, and all bets are processed in one transaction instead of one at a time." MultiBet is very similar to an electronic form of the printed bet slip, a copy of which is shown as FIG. 34. Referring now to FIG. 3, there is shown a screen illustrating a betting process used by Amtote Systems, Inc. of Hunt Valley, Md. FIG. 4 illustrates a screen showing a betting process used by Autotote Systems, Inc. of New York, N.Y. FIG. 5 depicts a screen illustrating another betting process utilized by United Tote Company of Glen Rock, Pa., assignee of the present invention. A betting process offered by Youbet.com, Inc. of Woodland Hills, Calif. is illustrated in FIG. 6, and another betting process provided by TVG Network of Beaverton, Oreg. is depicted in FIG. 7. Playboy Racing USA of Grantville, Pa. offers the betting process as illustrated in FIG. 8. The various screens illustrate attempts of known methods to implement pari-mutuel wager options on electronic interfaces. FIG. 9 comprises a flowchart of the pari-mutuel gaming activity offered by the screen of FIG. 8.

In other attempts to make pari-mutuel wagering easier, a wager amount and a "Quick Pick" have been developed. The Quick Pick selection allows patrons to place a wager without making a conscious bet selection that takes into account all aspects of the wager or without having to navigate through all of the various betting menus. Quick Pick selections may be made by selecting a pool and runners, or the patron may select the pool and the Quick Pick selects the runners. The Quick Pick selections are always random, and usually the same actions and decisions are required by the patron whether the Quick Pick selection is offered at a teller-operated terminal or a self-service terminal. FIG. 10 illustrates a betting interface provided by Autotote Systems, Inc. of New York, N.Y. that offers a Quick Pick selection. The betting interface of FIG. 10 only allows Quick Picks on the runner selection screen by pressing the button labeled "Qpk."

FIG. 11 illustrates another betting interface provided by Amtote Systems, Inc. of Hunt Valley, Md. that offers a Quick Pick selection. However, the betting interface of FIG. 11 only offers the Quick Picks on the runner selection screen. FIGS. 12 and 13 depict Quick Pick selections offered by United Tote Company of Glen Rock, Pa. on both the pool screen and the runner screen by pressing the "Quick" and "Qck" buttons, respectively. Internet betting sites typically do not offer Quick Picks.

Although Quick Picks are the most streamlined methods for placing wagers currently available, patrons or tellers must press multiple buttons or keys to place a Quick Pick pari-mutuel wager. Further, the Quick Picks require the patron to make multiple selections or button presses in order to place a wager at a self-service betting terminal. For instance, for a patron or teller to place a Quick Pick on his or her initial wagering attempt using a betting terminal offered by United Tote as depicted in FIG. 12 or 13, a patron needs to select 1) the track, 2) the race, 3) an amount of the wager, and 4) the Quick Pick pool and runner(s) at random. Thus, at least four selections are required. To place a Quick Pick using a betting terminal offered by Autotote or Amtote as respectively depicted in FIG. 10 or FIG. 11, respectively, a patron must select 1) the track and race, 2) an amount of the wager, 3) a pool, and 4) Quick Pick runner(s) at random. Thus, at least four selections are also required.

When patrons place multi-positional (for example trifecta) or multi-leg (for example Pick 6) pari-mutuel wagers, the patron typically selects runners for positions using one of two methods. In the first, more common method, the patron selects runners for the first position or leg, and then for the second position or leg, and so on until runners are chosen for each position or leg. Screens configured to allow patrons to select runners using this method are depicted in FIGS. 14 and 15. A second method, depicted in FIG. 16 is mainly used on Internet betting web sites. In the second method, the patron is presented with a field of runners and two or more positions in which the patron can place a runner. However, the patron must select each runner individually.

In the electronic pari-mutuel gaming industry, the interface screens of existing betting websites and electronic pari-mutuel betting terminals display the track, race, amount of wager and pool options with equal prominence when offering the pari-mutuel gaming activities. Tracks can currently add their graphics to the interface screen. Further, at racetracks and OTBs, only one method is used to prioritize betting options. Although the organizations running the pari-mutuel activities at the racetracks and OTBs may request that the tracks be listed in a specified order, the individual races, pools and wager amounts typically appear identically on the screen of the interface. By presenting betting options in this manner, there is little opportunity for the organizations to channel betting to desired tracks, races, pools and amounts. While the tracks do use prominence of video signals and special promotions, such as awarding double club points for betting on the live track, the existing methods do not influence the presentation of betting options. Tracks can presently make changes in the tote system that control the order in which tracks are listed, the pools available (and possibly pool listing order). Further, the existing methods are neutral from a patron's standpoint since the user interface does not react to organization priorities in any way, except that previously run races are dropped from the available race list. The user interfaces are substantially the same on Internet betting sites, with the exception that some hyperlinks may display the next several races in order to aid the user.

Simulcasting has made a great deal more betting propositions available to patrons. Some bettors would like the ability to set rules for placing wagers and automatically place those wagers. In addition, some bettors would like to extend the application of their rule beyond the current betting session—perhaps on pools running the next week or even the next month. The pari-mutuel industry does not currently allow bettors to set rules for placement of wager on races currently open for betting or on future races not currently open for betting. In pari-mutuel betting, the ability to place wagers for future races requires 1) that the totalisator system is set up to take wagers and 2) that the wagers are purchased at the time the order is placed. There is currently no facility for placing wagers on races and pools that are not set up in the totalisator system, and/or are not funded at the time the order is placed. Therefore, there is no ability for a patron to create rules for future placement of wagers automatically because wagers are officially recorded and, when applicable, tickets are printed only when the wagers are made.

BRIEF SUMMARY OF THE INVENTION

The present invention, in its various exemplary embodiments, includes pari-mutuel wagering methods and systems that make it easier for patrons of a pari-mutuel gaming establishment to place a pari-mutuel wager or multiple pari-mutuel wagers. Thus, the methods and systems help novice patrons feel more comfortable participating in the pari-mutuel gaming activities and enhance the ease and speed of placement of pari-mutuel wagers. Thus, the pari-mutuel gaming establishments employing the pari-mutuel gaming methods and systems described herein offer reduced costs of operation, while increasing the amount of wagering or wager "handle," defined as the total amount of money bet on a race or over a period of time.

Two factors have been statistically proven to positively affect wagering handle, the number of runners in a race and carryover pools. One exemplary embodiment of the invention involves prominently displaying at least one or both of these two factors on the interface screen or display element. In the exemplary embodiment, the number of runners in a given race is indicated on the interface screen, wherein the information depicting the number of runners is presented on or near the graphic or indicia that the patron uses to select a particular race for wagering. For instance, the interface screen may be configured to display races with large runner fields, i.e., races having a large number of runners, in addition to races with small runner fields, i.e., races having a smaller number of runners, so that wagering on the races with the smaller runner field is not negatively affected. This could be accomplished by including the number of runners with a large runner field, i.e., more than eight runners, and omitting the number of runners when the field is small. Furthermore, this exemplary embodiment includes displaying carryover amounts on pool (pick 4, pick 6, etc.) buttons on the interface screen when carryovers are present. This information attracts bettors and increases wagering.

In one exemplary embodiment, a method of conducting a pari-mutuel gaming activity is disclosed. The method includes displaying a list of runners in a race and providing patrons an opportunity to select at least one runner from the list of runners. In response to the patron selections, at least one pool of wager options that corresponds to the selected runners is displayed. Patrons are also provided with an opportunity to select at least one wager from the displayed pool of wager options.

In another exemplary embodiment, a system for conducting a pari-mutuel gaming activity is described. The system includes a display element for displaying information associated with the pari-mutuel gaming activity. The system also includes an input device for interacting with the at least one or more patrons and a computer configured with software. The software is operatively configured to enable the computer to conduct the pari-mutuel gaming activity, wherein patrons are provided with an opportunity to select with an input device at least one runner from a list of runners in a race displayed on the display element. At least one pool of wager options corresponding to the patron selections is displayed in response to the patron runner selections, and patrons are provided with an opportunity to select with an input device at least one wager from the displayed pool of wager options.

In a further exemplary embodiment, a method of conducting a pari-mutuel gaming activity is disclosed. The method comprises providing one or more patrons an opportunity to place at least one first wager on a race, and in response to the wager(s) placed, an opportunity to place at least one second wager. The second wager may include at least one runner of the first wager, or may present another, different and unrelated wagering opportunity.

In an additional exemplary embodiment, a pari-mutuel gaming system configured for play of a pari-mutuel gaming activity is described. The gaming system includes a display element for displaying information associated with the pari-mutuel gaming activity and an input device for interacting with at least one patron. A computer of the gaming system is operatively configured with software. The software enables the computer to direct the gaming system to conduct the gaming activity wherein at least one patron is provided with an opportunity to place at least one first wager on a race displayed on the display element. In response to the first wager placed, patrons are subsequently presented with a second opportunity to place at least one second wager displayed on the display element. The second wager may include at least one runner of the first wager or some other wagering proposition.

A further exemplary embodiment discloses a method of conducting a pari-mutuel gaming activity wherein a list of at least one runner in a race is displayed. The patron is provided with an opportunity to place at least one wager on the at least one runner, and responsive to the wager(s) placed, an area of a display element of a betting terminal or other interface representing the at least one runner is marked.

Another pari-mutuel gaming system operatively configured to conduct a pari-mutuel gaming activity is described in yet another exemplary embodiment. The gaming system comprises a display element that displays information associated with the pari-mutuel gaming activity and an input device for interacting with at least one patron. A computer of the gaming system is operatively configured with software that instructs the pari-mutuel gaming system to display a list of at least one runner in a race on the display element. Using an input device, one or more patrons are provided with an opportunity to place at least one wager on the at least one runner displayed on the display element, and an area representing the at least one runner is marked on the display element in response to the placed wager.

A further exemplary embodiment discloses an additional method of conducting a pari-mutuel gaming activity. The method includes selecting a portion of a wager on a race, wherein the selected portion of the wager is displayed to the patron. The patron is provided with an opportunity to place the wager by making a single selection, such as a Quick Pick.

In an additional exemplary embodiment, a pari-mutuel gaming system for conducting a pari-mutuel gaming activity is disclosed. The system includes an input device for interacting with at least one patron and a display element for displaying information associated with the pari-mutuel gaming activity. The system further includes a computer operatively configured with software that enables the computer to conduct the pari-mutuel gaming activity. In the pari-mutuel gaming activity, at least one portion of at least one wager on a race is selected by the software, and the selected portion of the wager is displayed on an area of the display element. One or more patrons are provided with an opportunity to place the at least one wager with the input device.

In yet a further exemplary embodiment, a method of conducting a pari-mutuel gaming activity including displaying at least one runner in a race in a table is disclosed. The table includes at least one column comprising the at least one runner and at least one row comprising the at least one runner. The at least one column and the at least one row intersect at least one cell. At least one patron is provided with an opportunity to place at least one wager on the race by selecting the at least one cell.

In an additional exemplary embodiment, a system for conducting a pari-mutuel gaming activity is described. The system includes a display element for displaying information associated with a pari-mutuel gaming activity and an input device for interacting with at least one patron. A computer is operatively configured with software operatively configured to enable the computer to conduct the pari-mutuel gaming activity. In the pari-mutuel gaming activity, a table comprising at least one runner is displayed on the display element, wherein the table includes at least one column having the at least one runner and at least one column having the at least one runner. The at least one column and the at least one row intersect at least one cell, wherein the at least one patron is provided with an opportunity to place at least one wager by selecting the at least one cell with the input device.

A method of presenting a pari-mutuel gaming activity is encompassed by another exemplary embodiment. The method includes providing a menu having at least one variable element, wherein the at least one variable element corresponds to at least one area displayed on a display element. An organization conducting the pari-mutuel gaining activity is provided with an opportunity to modify the at least one variable element. In accordance with modifications made to the at least one variable element, the at least one area displayed on the display element is changed, wherein the change affects the relative prominence of betting proposition(s), tracks, races, pools, or wager amount(s) such that wagering in channeled to desired betting. In another embodiment, the organization may add their graphic to the betting interface, wherein the graphic includes a selectable area that may allow patrons to automatically select a track and race for a wager. Options may also be presented in conjunction with the graphic, wherein the options enable patrons to finish a wager. This embodiment may be useful for advertising Pick 6 carry-overs and enable the track to channel betting.

In yet another additional exemplary embodiment, a system for presenting a pari-mutuel gaming activity is described. The system comprises a display element for displaying information associated with the pari-mutuel gaming activity, an input device for interacting with at least one patron, a computer operatively configured with software and a display for allowing an organization to view options for presenting the pari-mutuel gaming activity. The software is operatively configured to enable the computer to present a menu on the display, wherein the menu includes at least one variable element corresponding to at least one area displayed on the wager terminal. The organization is provided with an opportunity to modify the at least one variable element and in accordance with modifications made by the organization, the at least one area displayed on the display element is changed.

Another exemplary embodiment discloses a method of conducting a pari-mutuel gaming activity. The method includes providing at least one patron an opportunity to designate at least one condition for the placement of at least one wager on at least one race. In response to the at least one condition occurring, the at least one wager is placed on the at least one race.

In an additional exemplary embodiment, a system for conducting a pari-mutuel gaming activity is presented. The system includes a display element for displaying play of the pari-mutuel gaming activity and an input device for interacting with at least one patron. The system also includes a computer operatively configured with software, wherein the software is configured to enable the computer to conduct the pari-mutuel gaming activity. In the pari-mutuel gaming activity, at least one patron is provided with an opportunity to designate at least one condition for the placement of at least one wager and in response to the at least one condition occurring, the at least one wager is placed on the at least one race.

In a further exemplary embodiment, another method and another system for conducting a pari-mutuel gaming activity are presented. The method includes providing patrons an opportunity to select an area on a display element and, responsive to patrons selecting the area, the patrons are allowed to place more than one multi-position or multi-leg wager. The placement of the more than one multi-position or multi-leg wager may be effectuated without reselecting a pool.

BRIEF DESCRIPTION OF THE DRAWINGS

FIGS. 10-17 represent screens for implementing known pari-mutuel gaming activities of the prior art;

FIG. 25 is a screen depicting a gaming terminal displaying an indicated runner embodiment;

DETAILED DESCRIPTION OF THE INVENTION

Figure 1:
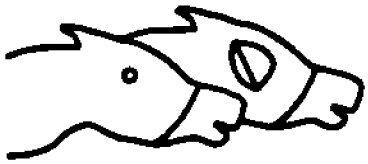
FIG. 1 (PRIOR ART)
FIG. 1 is a ticket representing a pari-mutuel wager placed by a patron as is known in the art.
Figure 1:
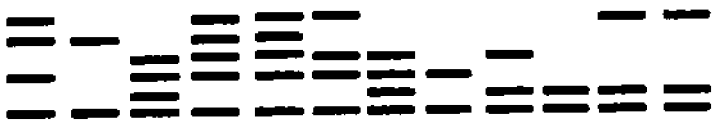
FIG. 1 (PRIOR ART)
Figure 1:
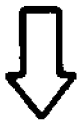
FIG. 1 (PRIOR ART)
Figure 1:
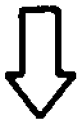
FIG. 1 (PRIOR ART)
Figure 2:
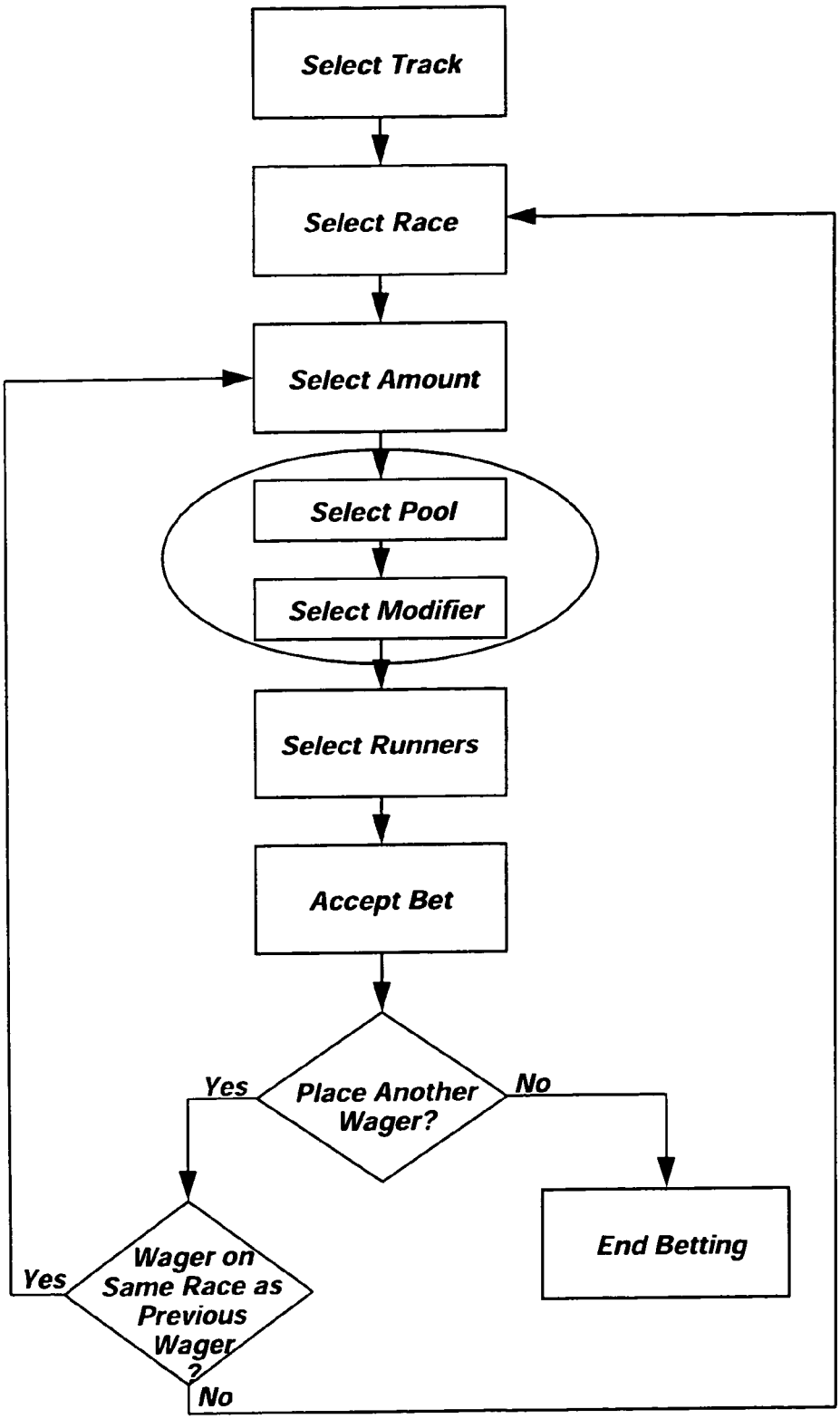
FIG. 2 (PRIOR ART)
FIG. 2 is a flowchart of a convention pari-mutuel betting activity.
Figure 3:
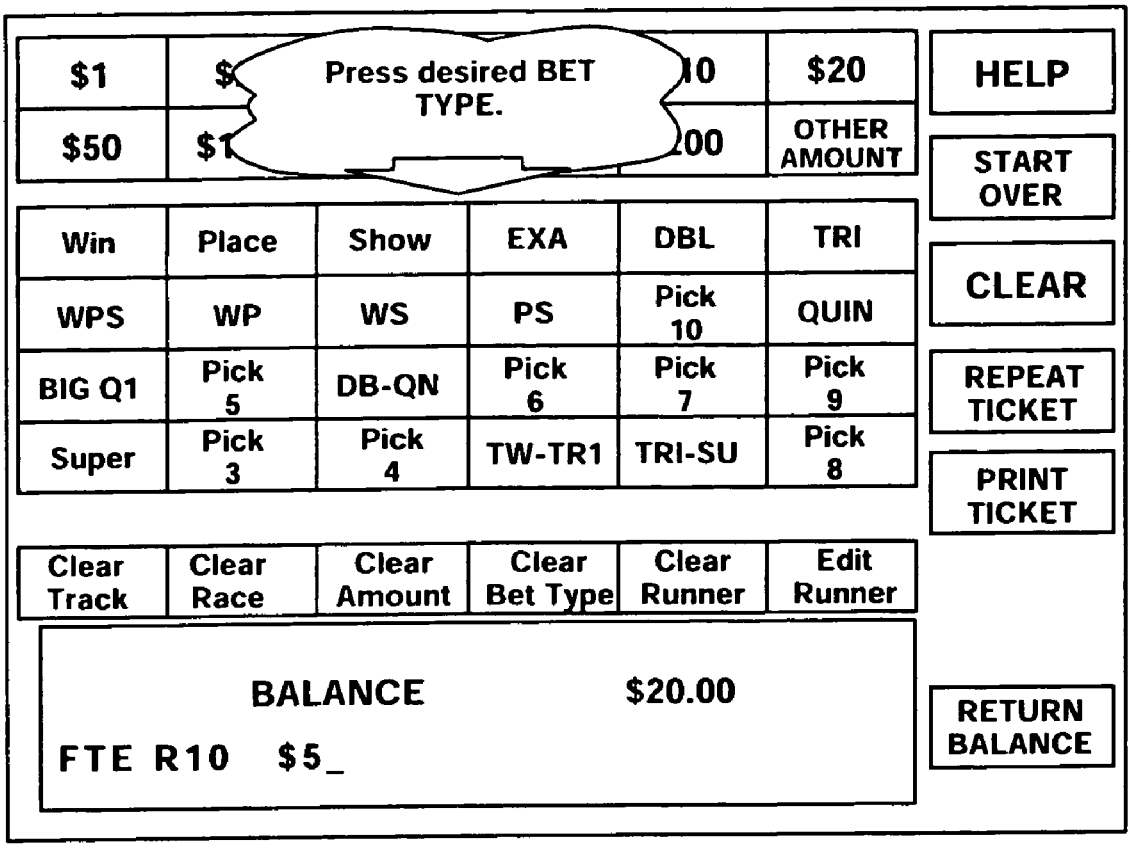
FIG. 3 (PRIOR ART)
FIGS. 3-8 represent screens for implementing known pari-mutuel gaming activities of the prior art.
Figure 4:
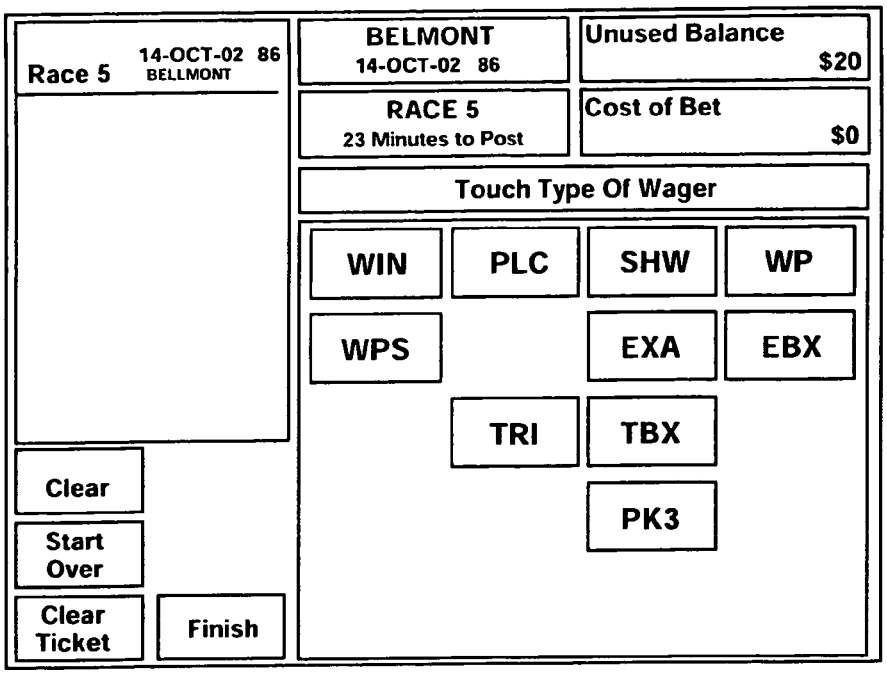
FIG. 4 (PRIOR ART)
Figure 5:
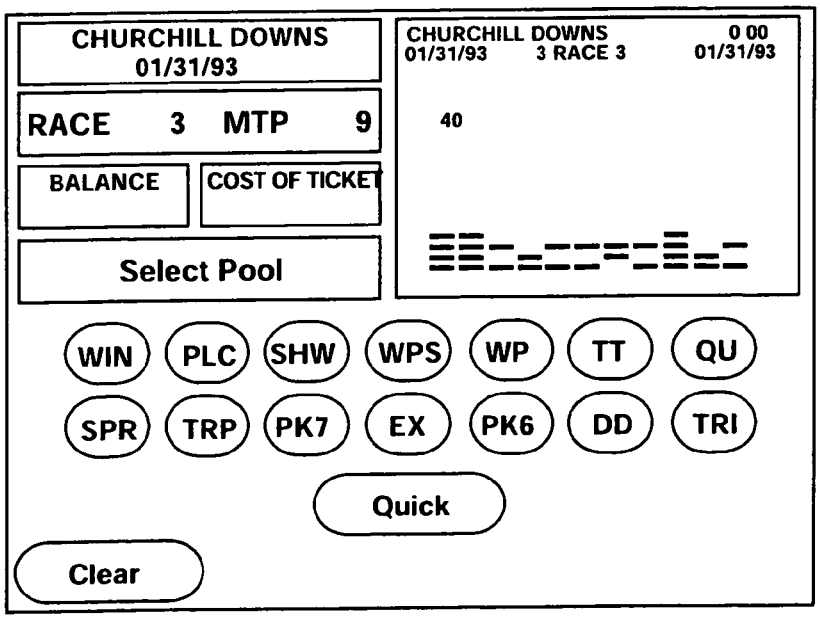
FIG. 5 (PRIOR ART)
Figure 6:
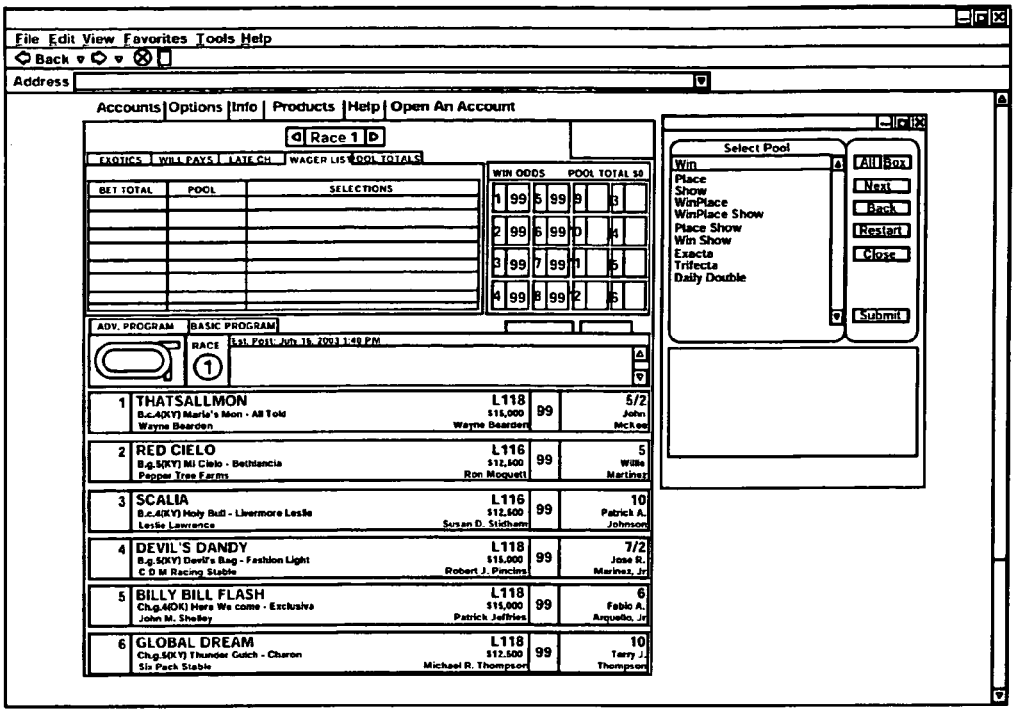
FIG. 6 (PRIOR ART)
Figure 7:
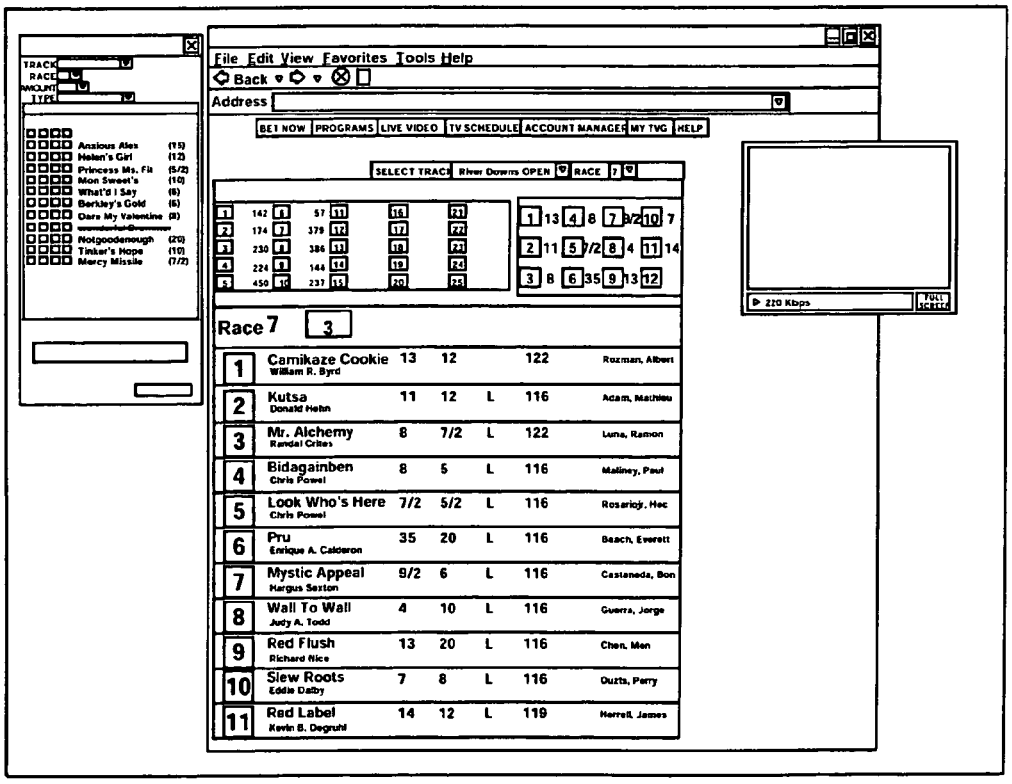
FIG. 7 (PRIOR ART)
Figure 8:
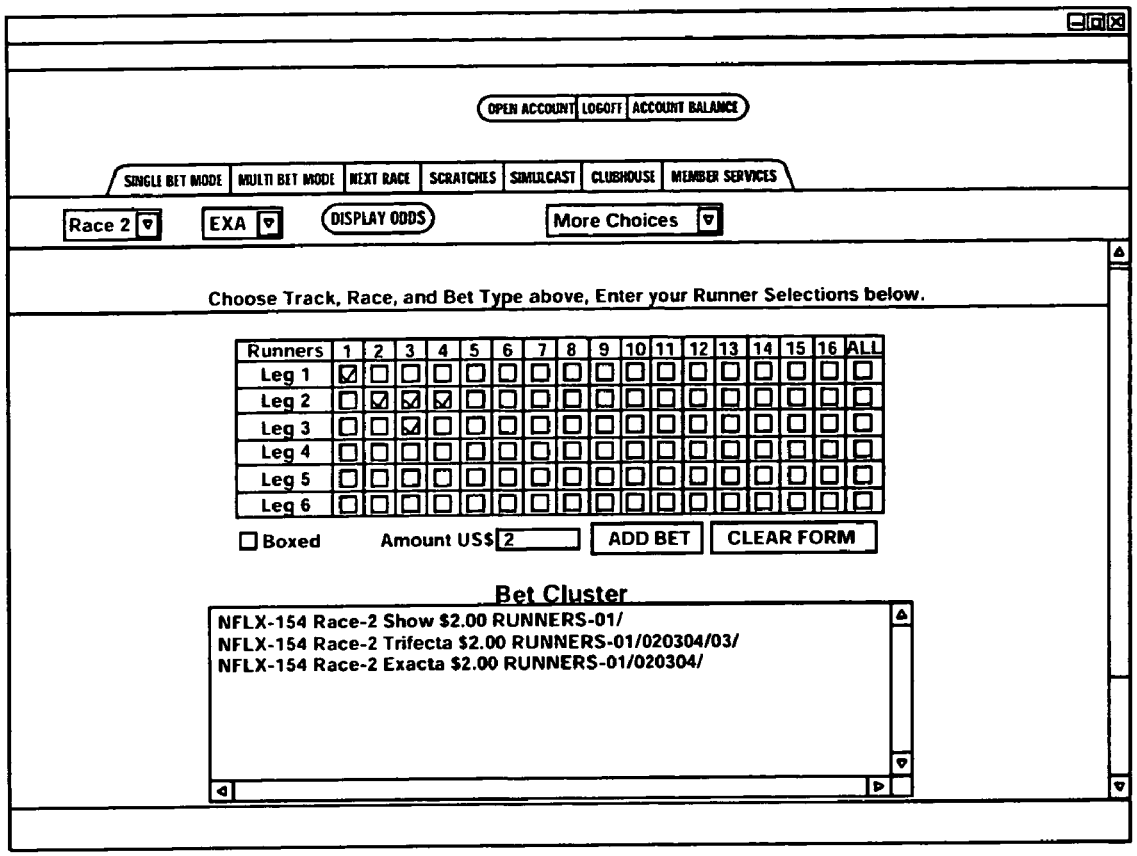
FIG. 8 (PRIOR ART)
Figure 9:
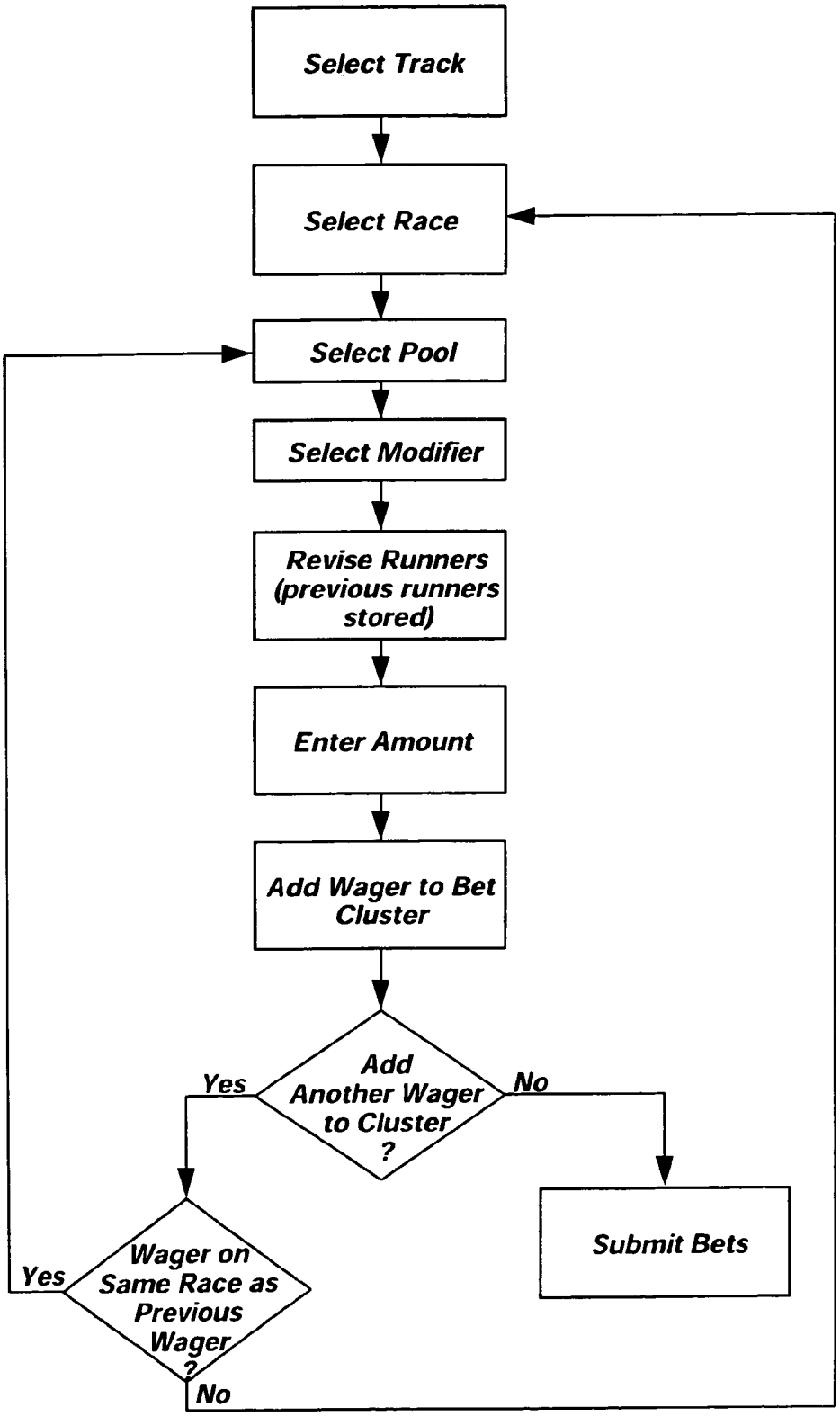
FIG. 9 (PRIOR ART)
FIG. 9 is a flowchart of the pari-mutuel gaming activity offered with the screen of FIG. 8.
Figure 10:
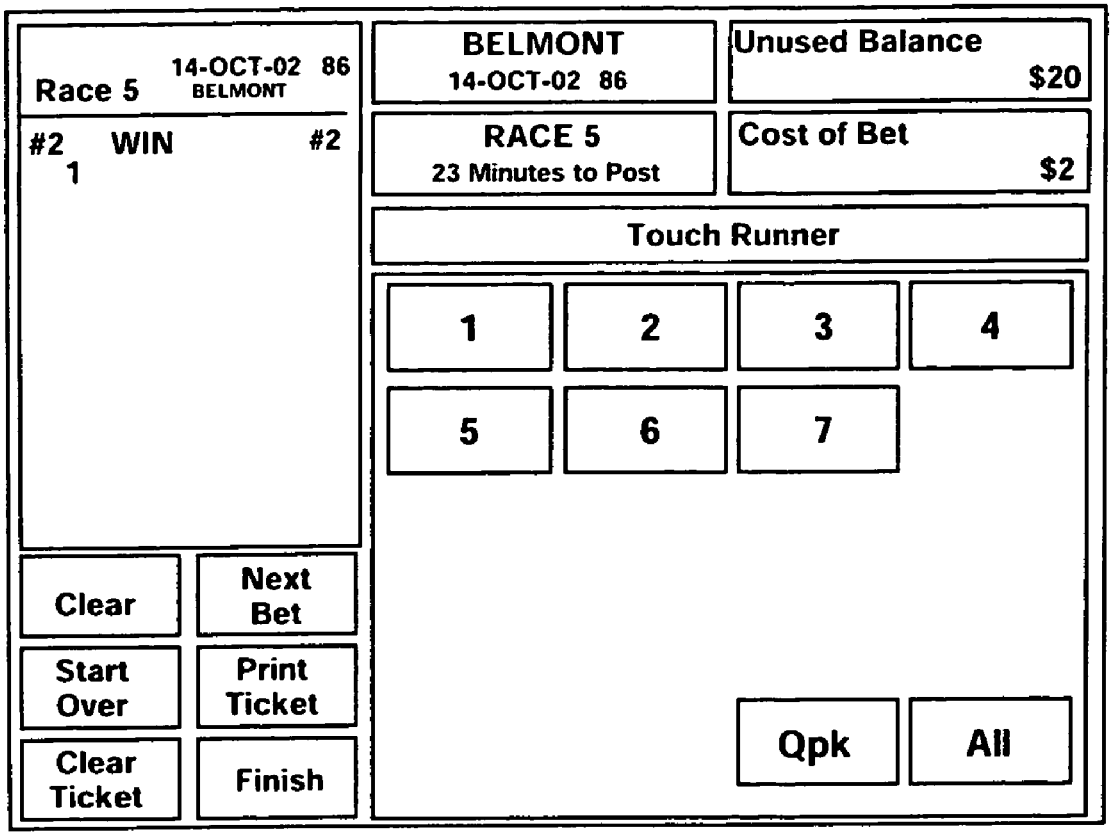
FIG. 10 (PRIOR ART)
Figure 11:
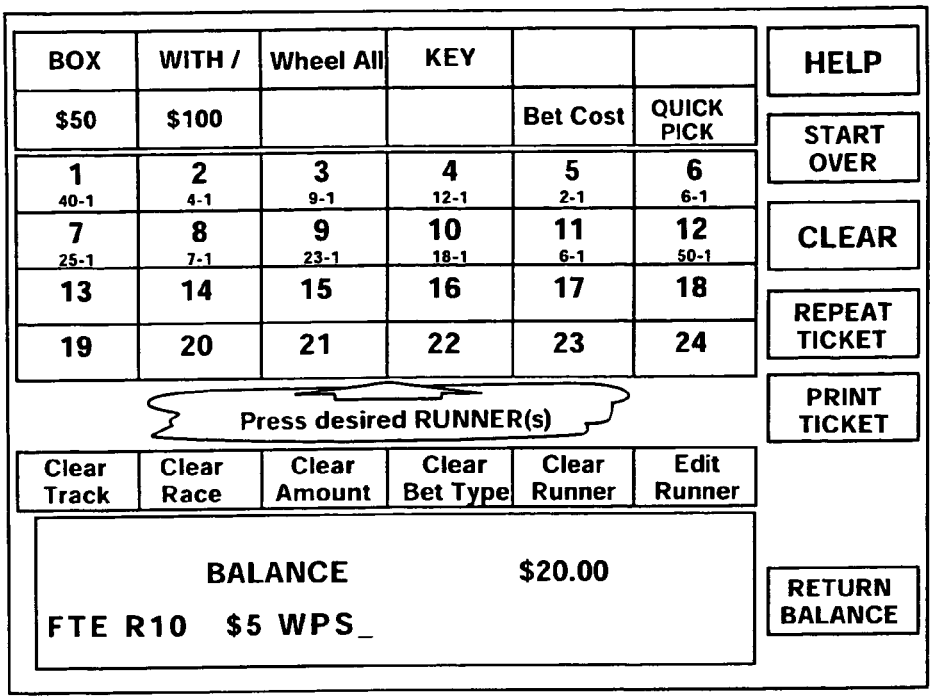
FIG. 11 (PRIOR ART)
Figure 12:
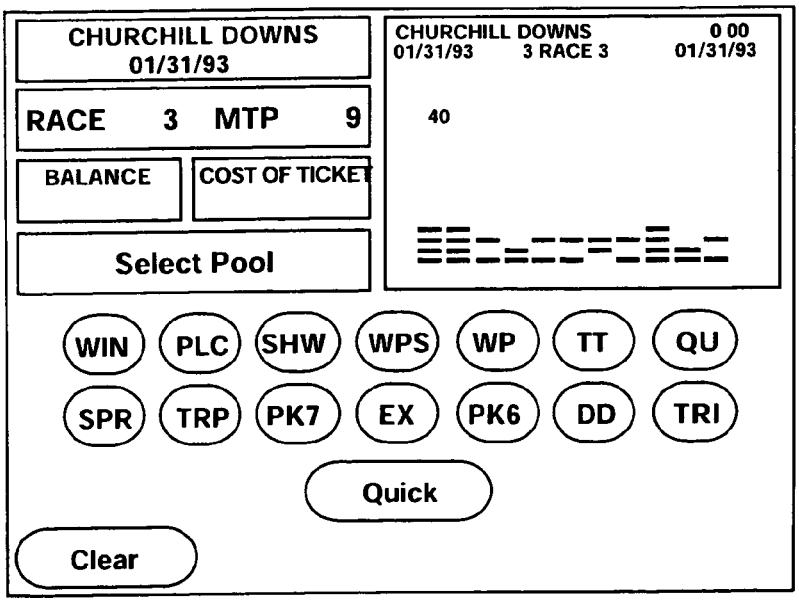
FIG. 12 (PRIOR ART)
Figure 13:
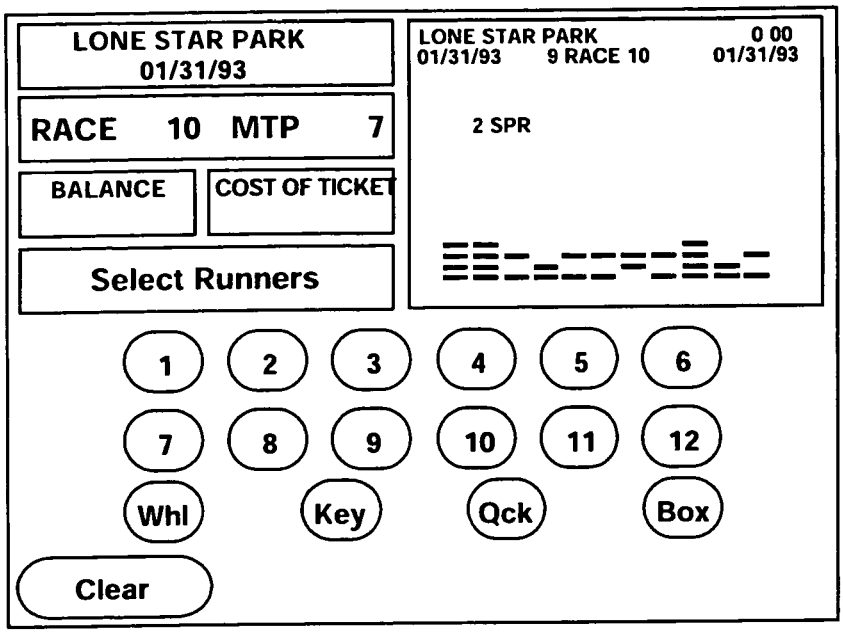
FIG. 13 (PRIOR ART)
Figure 14:
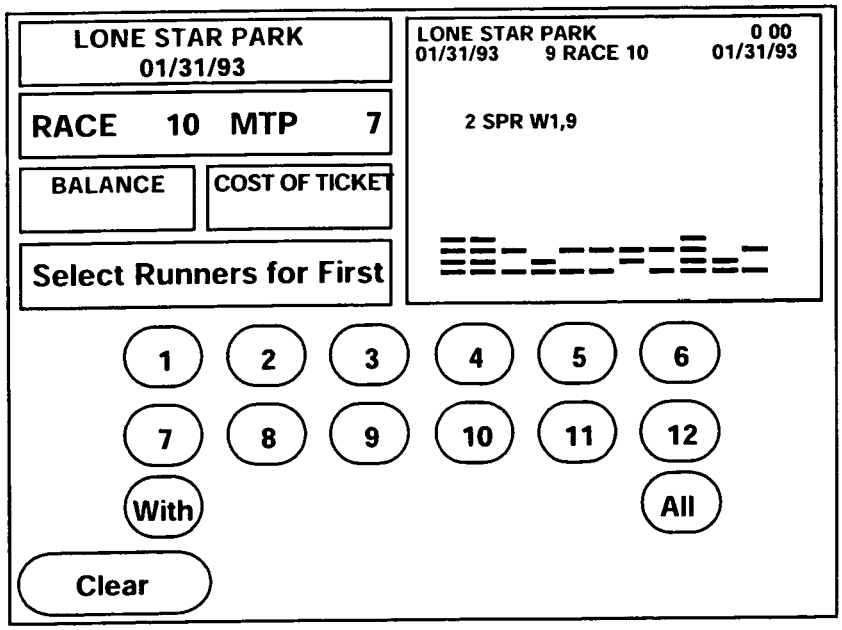
FIG. 14 (PRIOR ART)
Figure 15:
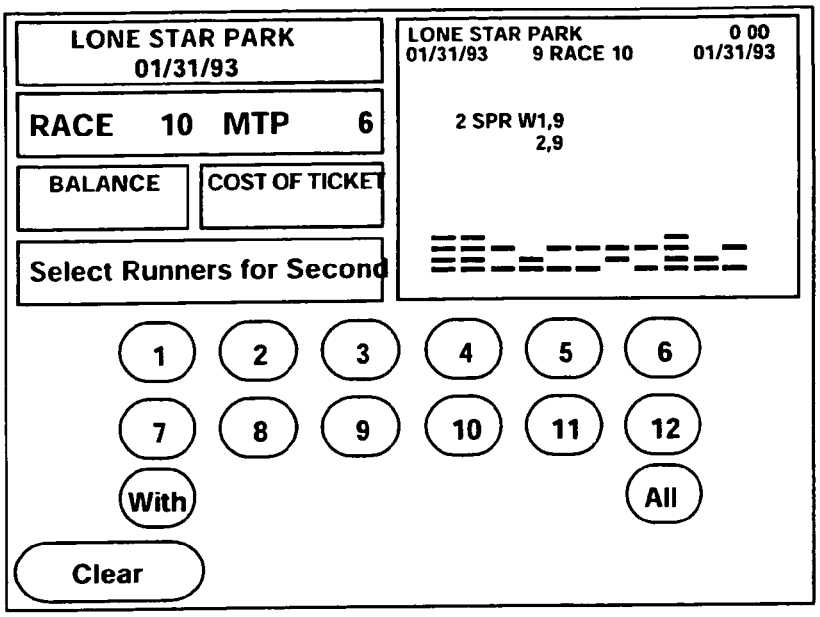
FIG. 15 (PRIOR ART)
Figure 16:
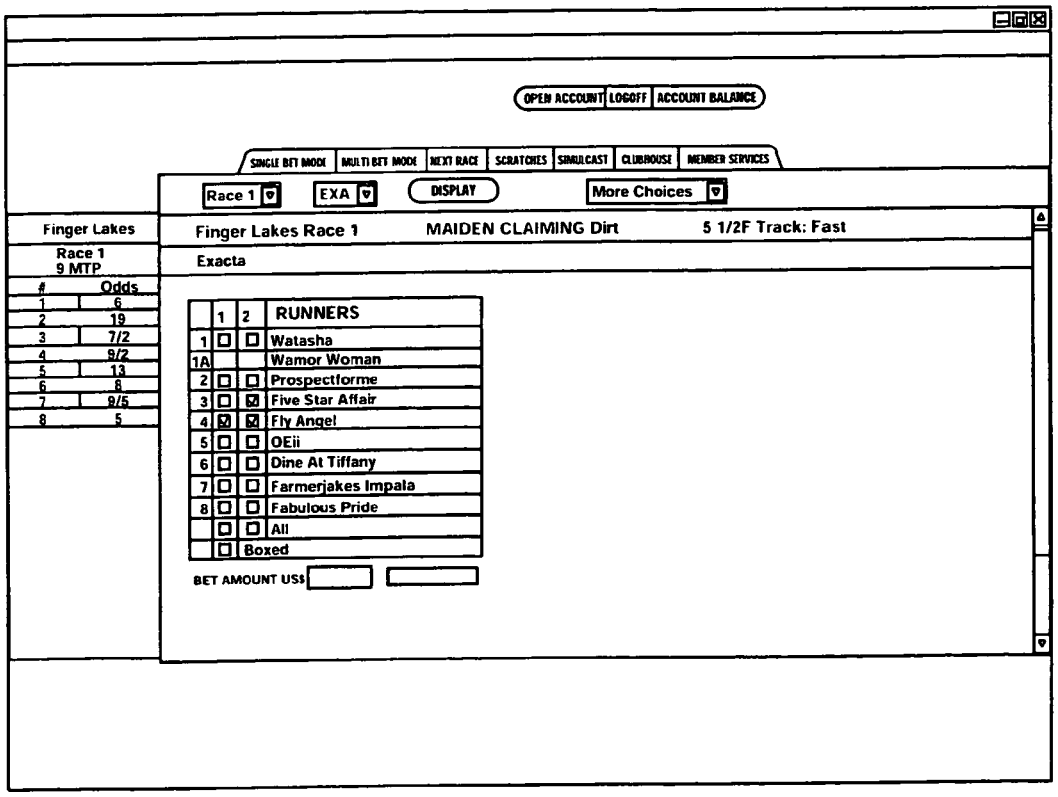
FIG. 16 (PRIOR ART)

Generally, the present invention includes new and enhanced methods of providing and conducting pari-mutuel gaming activities, and pari-mutuel gaming systems and gaming terminals and other electronic interfaces configured for play of the pari-mutuel gaming activities. While the present invention is described in terms of certain exemplary embodiments, the specific details of these exemplary embodiments are set forth in order to provide a thorough understanding of the present invention. It will be apparent, however, that the present invention may be practiced in various combinations and modifications of the exemplary embodiments presented herein.

Two factors have been statistically proven to positively affect wagering handle, the number of runners in a race and carryover pools. Thus, the invention involves prominently displaying at least one or both of these two factors on the interface screen or display element. The number of runners in a given race is indicated on the interface screen, wherein the information depicting the number of runners is presented on or near the graphic or indicia that the patron uses to select a particular race for wagering. For instance, the interface screen may be configured to display races with large runner fields, i.e., races having a large number of runners, in addition to races with small runner fields, i.e., races having a smaller number of runners, so that wagering on the races with the smaller runner field is not negatively affected. This could be accomplished by including the number of runners with a large runner field, i.e., more than eight runners, and omitting the number of runners when the field is small. Furthermore, the invention includes displaying carryover amounts on pool (pick 4, pick 6, etc.) buttons on the interface screen when carryovers are present. This information attracts bettors and increases wagering.

The exemplary embodiments described herein may be implemented on pari-mutuel gaming systems including online wagering systems and betting, or wagering terminals (such terminals including any suitable electronic interface) located at pari-mutuel gaming establishments, including, but not limited to, thoroughbred horse tracks, harnessed horse tracks, car tracks, greyhound racetracks, jai alai frontons and OTB facilities. The pari-mutuel wagering systems are also referred to as "tote systems" and include wagering terminals, a computer server having computers and peripherals, software configured to conduct the pari-mutuel gaming activities, tote boards, and other displays and video generation equipment. The pari-mutuel gaming systems process wagers, calculate and display odds, probables (the estimated payoff odds at post time) and payoff information, and the wagering terminals perform the functions of selling and cashing betting tickets, displaying odds and probables as well as managing accounts set up by players.

As described herein, reference will be made to runners participating in a race. As known in pari-mutuel wagering, wagers are also made on games of jai alai and on other sporting events. Thus, as described herein, the reference to a "runner" also includes a participant, such as a player or a team, in a game of jai alai or another sporting event and the reference to a "race" will also include a game of jai alai or other sporting event. In jai alai, the participants or team score points, and the first participant to score a specified number of points wins. Thus, the jai alai participants "race" to be the first participant to score the specified number of points, and participants are placed based on the number of points scored, in a manner similar to runners placing in a race. The pari-mutuel gaming activities described herein may also be used for wagers placed on the prices of commodities, wagers made on the stock market (indices, stocks, funds, etc.) and trends and futures associated therewith, wagers made on currency exchange rates and futures wagers made on any type of race or other event or trend on which wagers may be placed.

The pari-mutuel gaming activities described herein may be implemented by configuring software and hardware of the pari-mutuel gaming systems to display, present and offer the pari-mutuel gaming activities to patrons of the pari-mutuel gaming establishments. The gaming activities are presented or displayed to the patrons, who will also be referred to herein as players, with wagering terminals that include self-service terminals located onsite (i.e., hard-wired or portable devices), offsite betting devices (i.e., located at OTBs, accessed by the Internet, cell phones, PDAs) or to teller-operated terminals. The gaming activities may be presented on any electronic device that is configured to visually display or otherwise convey information associated with the pari-mutuel gaming activity, accept input from a patron, and communicate with a pari-mutuel gaming system, such as with the Internet, phone lines, or with radio waves. The electronic devices include, without limitation, personal digital assistants (PDAs), remote terminals and cell phones. As known in the art, terminals may include a display element for displaying information related to the pari-mutuel gaming activity to the player at the self-service terminal or the teller at the teller-operated terminal. The display element may comprise any type of device for displaying electronic data including for example a computer monitor, a cathode ray tube (CRT) monitor, a liquid crystal display (LCD) monitor, a light-emitting diode (LED) screen, a television monitor, a touch-sensitive screen, a plasma monitor, a projection monitor, a heads-up display, or a holographic display. The terminals also include an input device that allows the player or the teller to input wagers made by the players. The input device may be a keypad or keyboard having keys or buttons, a touch screen, an overlying touch screen, a light pen, a mouse, a touchpad, a trackball, a voice recognition device or any other known input device associated with electronic devices. The exemplary embodiments described herein may also be implemented on electronic interfaces in other media including the Internet.

Runner-Focused Betting

Figure 18:
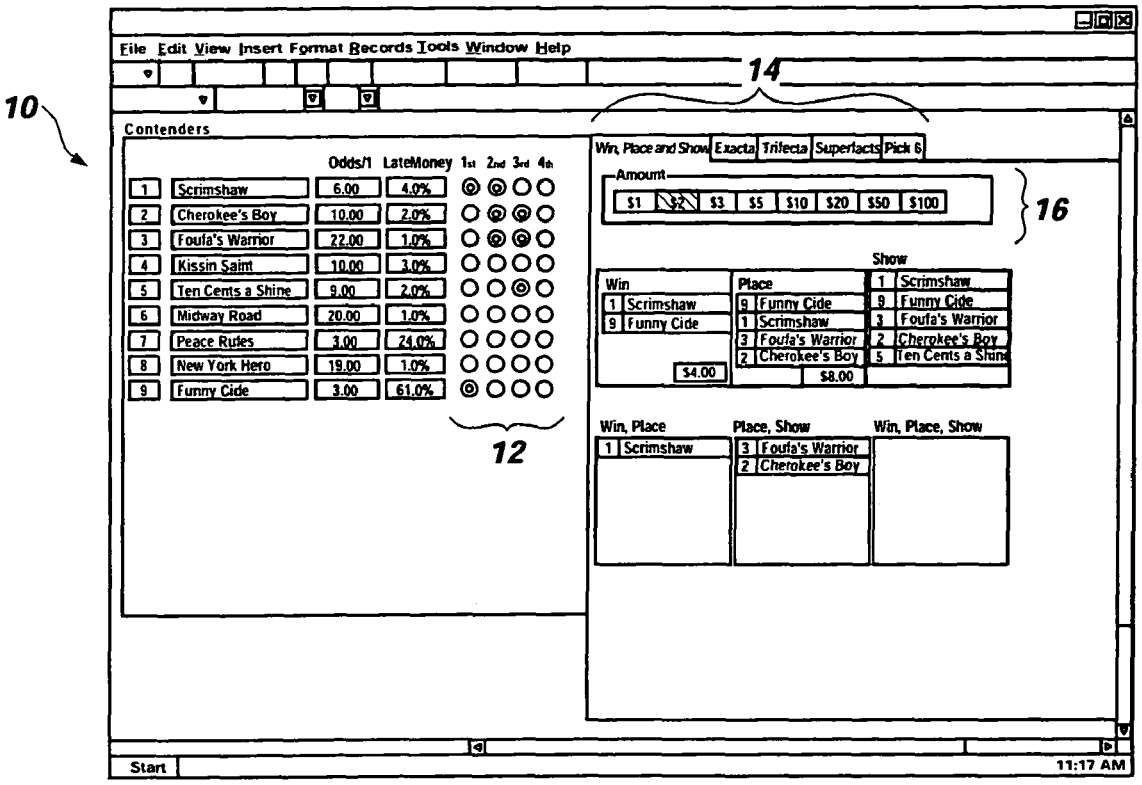
FIG. 18 illustrates a screen of a gaming terminal configured with one embodiment of a positional betting activity.

In one exemplary embodiment, a pari-mutuel gaming activity referred to herein as positional betting allows patrons to simultaneously select runners for focus (i.e., a runner for which a patron wants to review betting options), select positions of the runners in which the patrons want to review betting options, and review multiple, severable pool betting options for the selected runners, thus, allowing the patrons to place wagers on selected runners across multiple pools. Referring to FIG. 18, there is illustrated generally at 10 a display element, such as a screen, for conducting a positional betting activity. The screen 10 displays a list of runners of an upcoming race and different betting combinations including the runners to a patron, wherein the patron selects the runner using radio buttons 12, or another input device. The betting combination options are presented to the patron on the right half of the screen 10. The right half of the screen 10 includes tabs 14 for each of the major betting pools including for example and without limitation, Win, Place and Show (WPS), Exacta, Trifecta, Superfecta, and Pick 6. The various wager amounts are also presented on activatable buttons 16. To view a variety of Exacta wagers for the selected runners, the patron selects the Exacta tab of the tabs 14, or selects a different tab to view options for a different pool. The arrangement of the various indicia including radio buttons 12, tabs 14, and activatable buttons 16 on the screen 10 also allows for the presentation of odds or other tote information that is relevant for the chosen pool.

Figure 19:
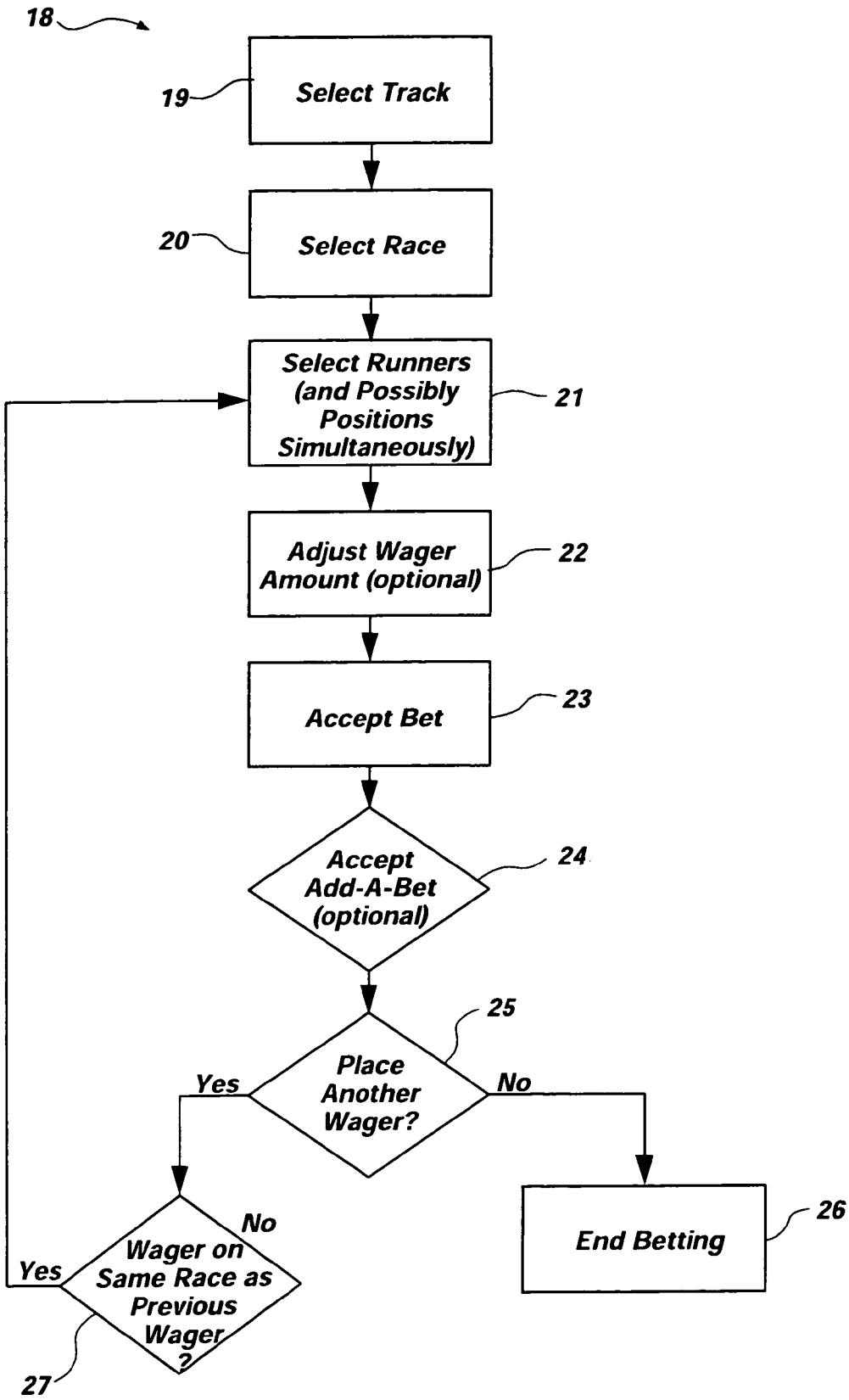
FIG. 19 illustrates a flowchart for presenting patrons with a positional betting or runner-focused betting method.

FIG. 19 is a flowchart generally at 18 that illustrates one embodiment of a method of conducting a positional betting or runner-focused betting method of the present invention. The method may be presented to a patron using one of the screens described herein with reference to runner-focused betting. The method includes providing a patron with an opportunity to select a track at box 19 and an opportunity to select a race at box 20. The patron is provided with an opportunity to select at least one runner for focus in the race at box 21. In another embodiment, the patron may be provided with an opportunity to select positions of the runners simultaneously with selecting the runners at box 21. Responsive to the runners selected by the patron, at least one wager option is presented to the patron on one of the screens. The patron may also be provided with an opportunity to adjust an amount of the wager at box 22, and may accept one of the displayed wager options, or a bet, at box 23. In another embodiment, the patron may accept an add-a-bet option at box 24, which will be described in more detail herein. Responsive to the patron accepting or placing a bet at box 23 or an added bet at box 24, the patron may be provided with another opportunity to place another wager at box 25. If the patron decides not to accept another wager, the betting ends at box 26. If the patron accepts the opportunity to place another wager at box 27, the player may be prompted with an opportunity to wager on the same runners as previously selected or select new runners for focus at box 21. The player may continue adding bets or selecting different runners for focus using one of the various screens.

Figure 20:
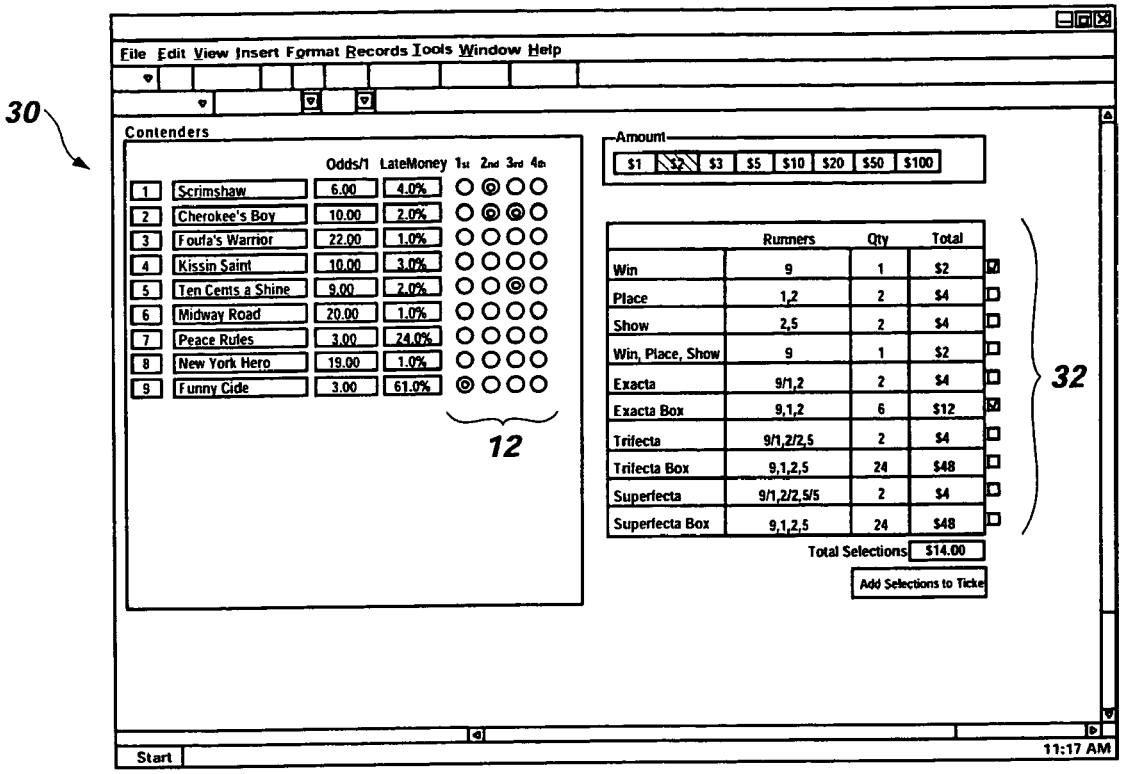
FIG. 20 depicts another screen of another embodiment of the positional betting activity.

FIG. 20 illustrates a screen generally at 30 for conducting another exemplary embodiment of the positional betting gaming activity. A player selects radio buttons 12 using an input device to select runner and position combinations of an upcoming race. The right half of the screen 30 simultaneously displays betting options for all pools 32 as the player selects runners using the radio buttons 12. Box wagers are included in the pools 32 in addition to the selections made by the player. Other betting options that may be displayed include, without limitation, Wheels (a wager on all possible combinations of an exotic wager using at least one runner as a key), patron selected runners paired with runners selected by the system or terminal randomly or based on nonrandom criteria for example, the runner with the lower win odds or "favorite," or other betting options. The various betting options that are displayed on the screen 30 may be determined by the betting facility or the preference settings of the patron. The display and changing of numerous betting options for patron selected runners is believed to increase the patrons' likelihood of wagering and the frequency thereof.

Figure 21:
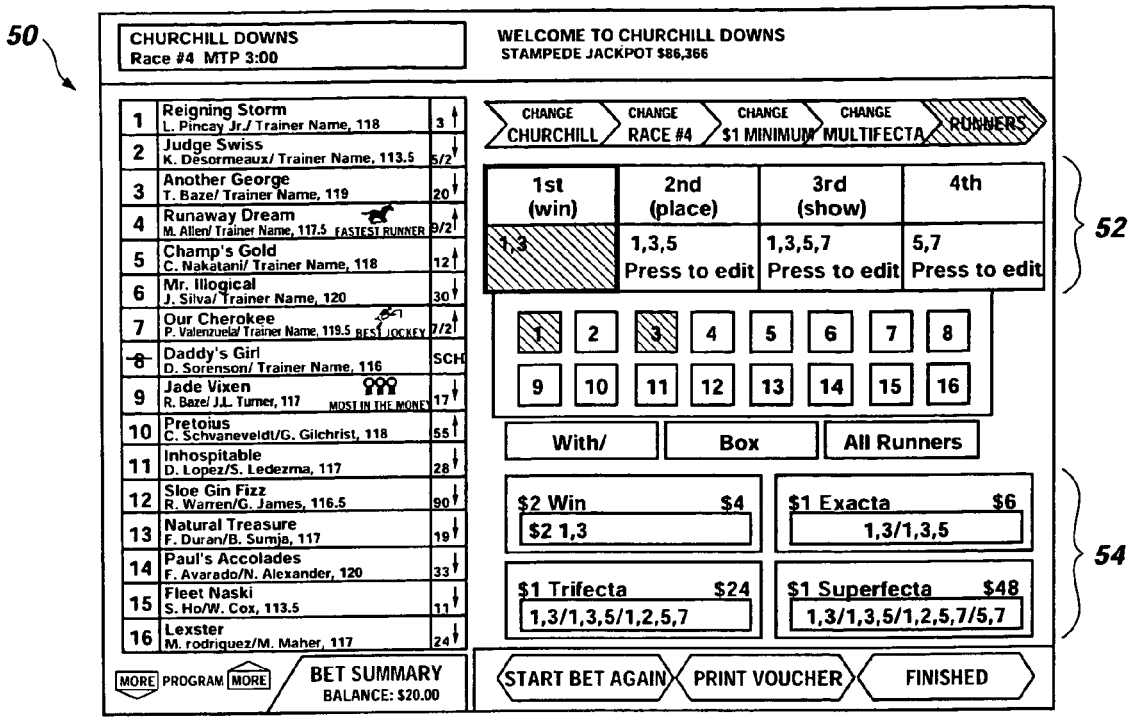
FIG. 21 is another screen of a further embodiment of the positional betting activity.

Another exemplary embodiment of a screen generally indicated at 50 depicting play of a positional betting gaming activity is shown in FIG. 21. On the screen 50, the patron enters runners in each of the $1^{st}$, $2^{nd}$, $3^{rd}$ and $4^{th}$ positions at 52. Multiple wager options are simultaneously presented to the player with total wager costs presented to the player on buttons 54 at the bottom right hand area of the screen 50. To place one of the illustrated wagers, the bettor selects the button 54 using an input device corresponding to the wager that the patron desires to select including, but not limited to, Win, Exacta, Trifecta and Superfecta.

It will be apparent that FIGS. 18 and 20-21 depict only three of many possible graphic approaches to implementing positional betting and that other graphic approaches are contemplated. For instance, the graphical representation of screens used to implement the positional betting activity may be varied by the needs and motivations of the patron group at the pari-mutuel gaming establishment, the venue in which the wagers are to be placed, and the betting terminal hardware and software capabilities of the pari-mutuel gaming establishment.

Figure 22:
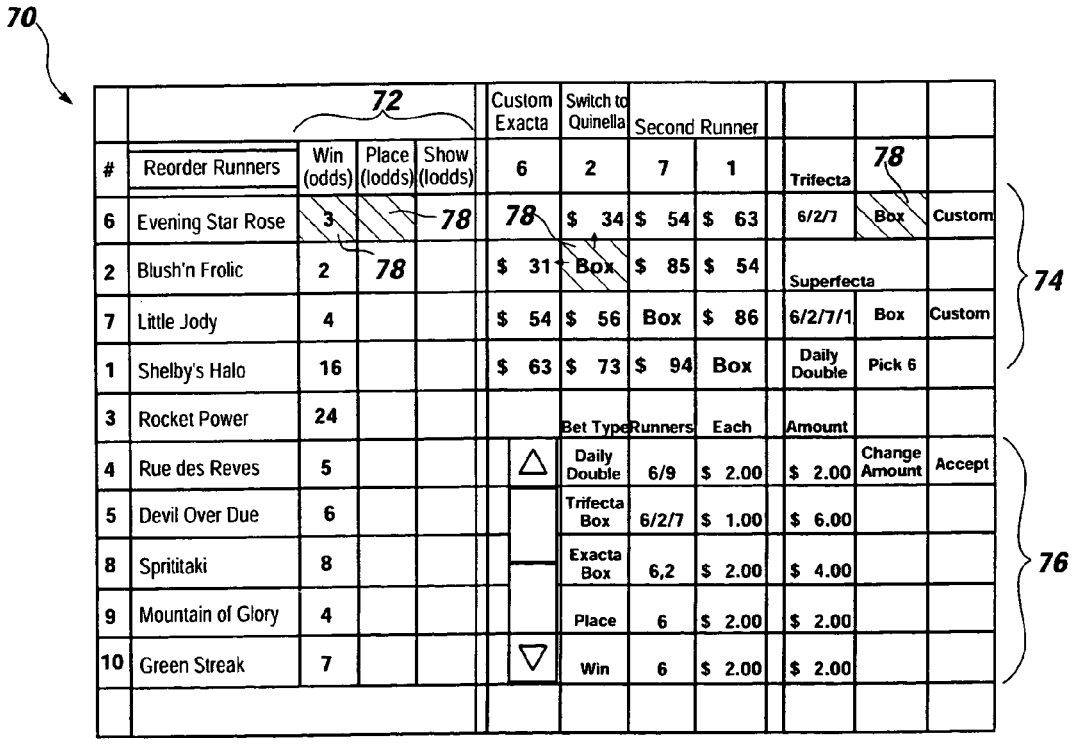
FIG. 22 illustrates a screen of a gaming terminal configured with a priority betting activity.

In another exemplary embodiment of the present invention, a pari-mutuel gaming activity referred to as priority betting is described. In priority betting, a patron selects a number of runners, such as four, for focus. A screen of a gaming terminal presents logical betting options for the runners selected by the patron. Referring to FIG. 22, there is shown a screen generally at 70 for implementing priority betting. As illustrated, odds 72 and probables 74 data are shown on selectable buttons, and a total cost 76 of the wagers is shown at the bottom of the screen 70 once the patron selects one of the possible wagers. In another exemplary embodiment, the bet costs may also be displayed on the buttons. Shaded squares 78 indicate buttons that have been selected by the patron in the exemplary embodiment. The various squares selected by the patron may be visually highlighted in various colors or can be marked with other distinguishing characteristics such that both beginner and experienced patrons are more easily able to readily distinguish selected squares from nonselected squares and the data that corresponds to the various squares. By allowing patrons to view and more easily assimilate the various betting options with shaded squares 78, they are able to make better-informed, conscious tradeoffs between the risks and rewards of possible wagers.

Although not illustrated, the screen 70 may be preceded by another screen asking the patron to select a number of runners, such as four, in an order of preference for wagering similar to the screen 10 of FIG. 18. In this manner, patrons are encouraged to select multiple runners, which increases the likelihood that a multi-runner wager (such as an exotic wager including, without limitation, Exactas and Trifectas) is selected by the patron. Priority betting is simpler than positional betting in that runners are merely ordered and betting options are presented in a manner consistent with the ordering. Since the simplicity of priority betting provides the patron with less distraction in terms of an ability to customize bets by adding and removing runners from certain positions as is done with positional betting, priority betting may be favored by novice players and less so by more sophisticated players.

In yet another exemplary embodiment, a pari-mutuel gaming activity referred to as a "bet upsell" is described. In the bet upsell, patrons may be automatically presented with additional logical bets to augment previous bets as recorded in the wagering system or presented with another wagering proposition. A review of patron ticket purchasing behaviors has revealed that many patrons bet on their favored runner across multiple pools. Thus, the bet upsell allows patrons to more readily select these logical bets. The bet upsell can be implemented on existing gaming terminals without having to substantially change current betting processes or interfaces.

Figure 23:
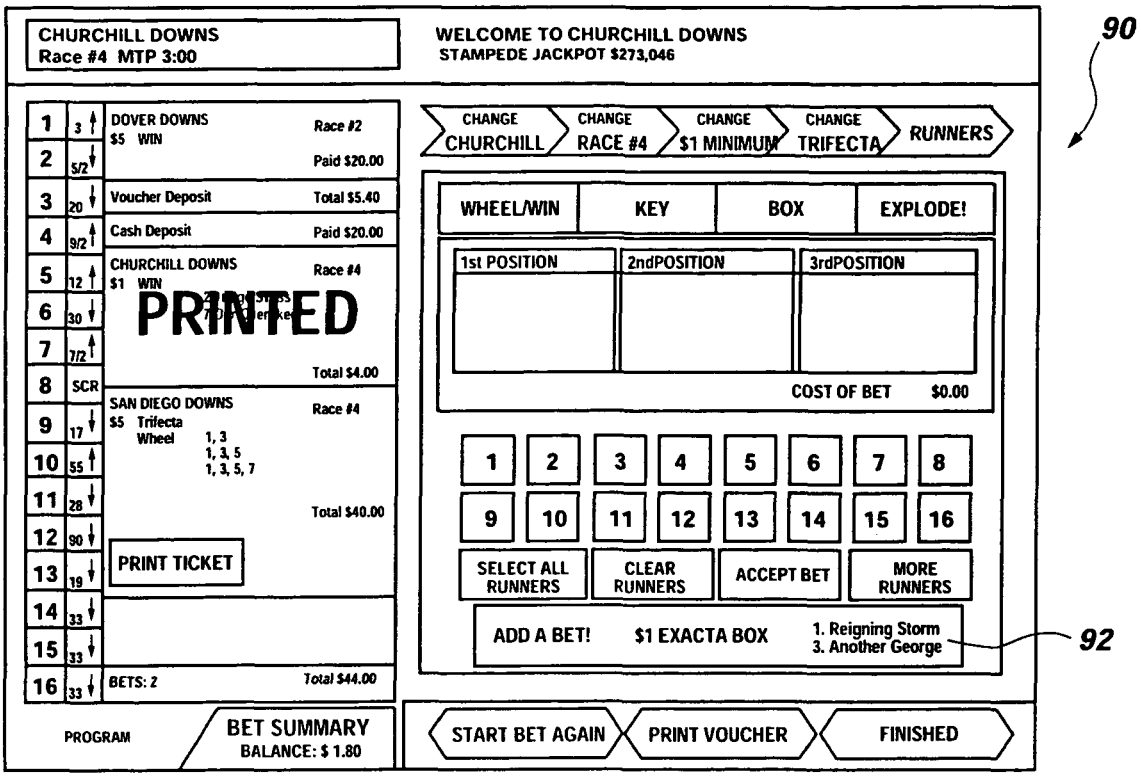
FIG. 23 depicts a screen of a betting interface configured with one embodiment of a bet upsell.

The bet upsell is illustrated generally on a screen 90 in FIG. 23. As depicted on the screen 90, a patron has placed a Trifecta wager on the 1, 3 (win position)/1, 3, 5 (place position)/1, 3, 5, 7 (show position) and is presented with an opportunity to purchase an additional Exacta box wager at button 92 on what appear to be the patron's favorite runners, the #1 runner and the #3 runner. In another exemplary embodiment, if the patron had first placed the Exacta wager on 1, 3, the pari-mutuel wagering system could present the patron with an Add-A-Bet option for a Trifecta wager by providing the patron with an opportunity to select a third runner according to one of the following methods: lowest odds runner not covered, a runner receiving a lot of late money, a speed rating, a manual selection by the patron, or any other known method of adding a runner not selected in a previous wager to fill in the third position of the Trifecta wager. In another embodiment, another wagering proposition not related to the current race may be presented to the patron. The bet upsell increases the likelihood of impulse wagering by the patron and makes the betting process faster. The screen 90 may also be configured to show various tote data, such as showing the probable price on the Exacta 1, 3 wager, in order to provide the patron with significant risk or reward information.

Figure 24:
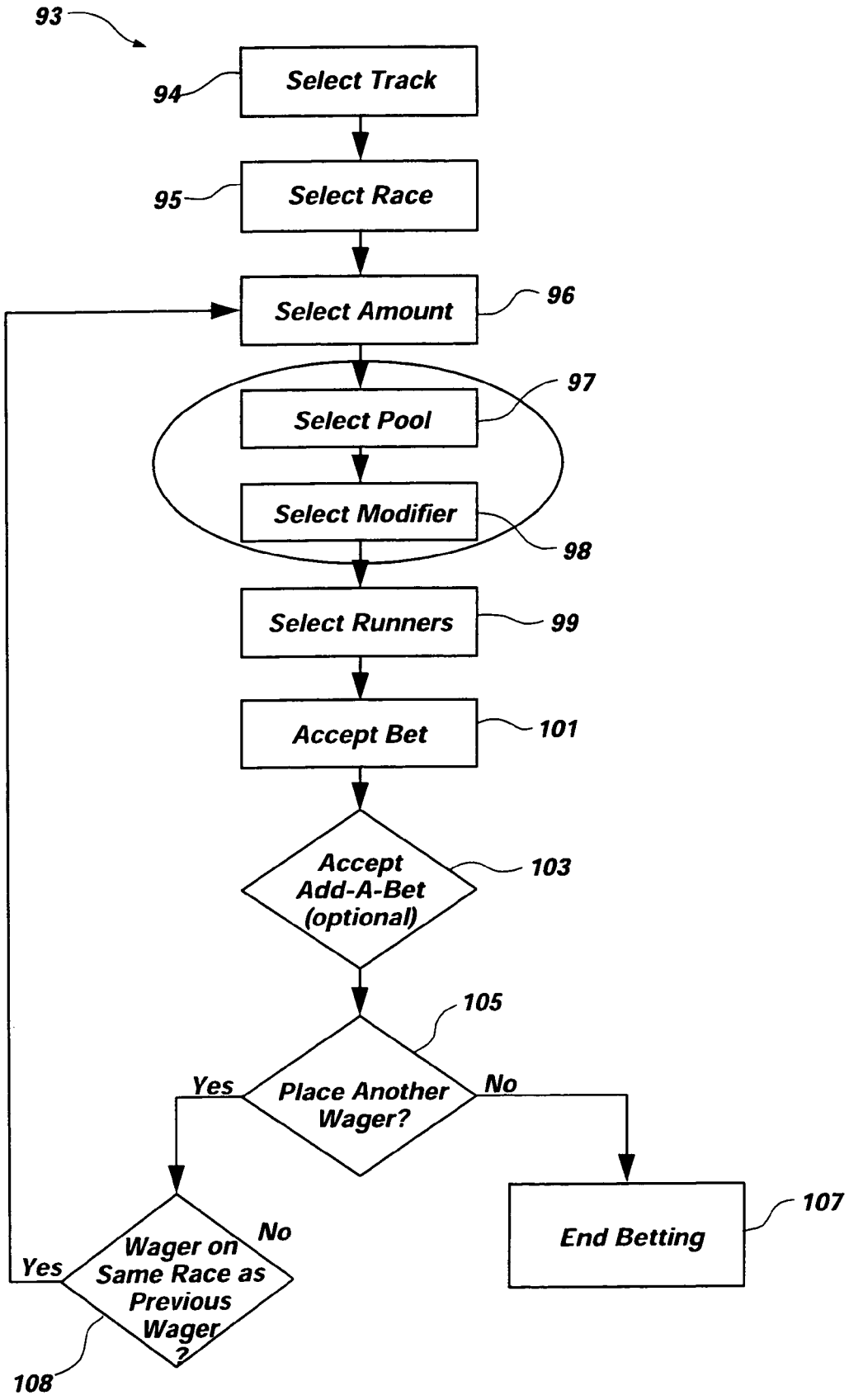
FIG. 24 is a flowchart for presenting patrons with an Add-A-Bet wagering method.

Referring now to FIG. 24 there is illustrated a flowchart generally at 93 for presenting a patron with the Add-A-Bet using one of the screens of the present invention. The patron is provided with an opportunity to select a track at box 94 and an opportunity to select a race at box 95. The patron may also select an amount of a wager at box 96. The patron is also provided with an opportunity to select a pool at box 97 and an opportunity to select a modifier at box 98 and, in another exemplary embodiment, the patron may select the pool and the modifier simultaneously as indicated with an ellipse around boxes 97 and 98. A patron is further provided with an opportunity to select runners of the race at box 99 and may accept a bet at box 101. The patron may be provided with an opportunity to accept an Add-A-Bet option at box 103 or the patron may be provided with another opportunity to place another wager on the race at box 105. If the patron decides not to place another wager, the betting ends at box 107. Alternatively, if the patron decides to place another wager on the same race as the previous wager as indicated at box 108, the patron is presented with the opportunity to select an amount of the another wager at box 96. In another embodiment, the patron is presented with the opportunity to Add-A-Bet or another wagering proposition that does not relate to the current race. The patron may continue to place additional wagers as illustrated in the flowchart 93 up until a predetermined period of time before post of the race wagered on.

Contrary to practices in most retail environments, racing and pari-mutuel wagers are not organized according to price points. The racing and pari-mutuel wagers are advertised as $1 or $2 wagers, and it is up to the patron to structure wagers that balance the patron's desired risk (cost of wagers) with reward (possible winnings) for a race. The runner-focused betting embodiments described herein enables the pari-mutuel betting facility to proactively present higher cost wagers by encouraging patrons to select multiple runners and by presenting additional betting options for boxed wagers, wheeled wagers and pools that may not have occurred to the patron. The presentation of multiple bet combinations and the ease with which the multiple bet combinations can be placed provides a service to the patrons and encourages impulse bets, thus increasing the wager handle for the pari-mutuel betting facility.

The runner-focused betting embodiments are also consistent with the mental process that a large percentage of players employ. Generally, players determine the likelihood of each runner finishing the race in a given position, review odds and probable payout information for those runners, and decide on ways to bet on the runners using multiple pari-mutuel pools. The runner-focused betting embodiments described herein help the player by displaying logical wager options that may not have occurred to him or her. The runner-focused betting embodiments also allow patrons to cover various runner or pool combinations with greater speed and accuracy versus entering each wager individually. The reduced time required to review tote data, evaluate betting combination options, and place wagers will make the pari-mutuel gaming experience more enjoyable for patrons. From the standpoint of the track, faster bet entry shortens the lines of patrons waiting to place wagers and lessens the need for additional ticket selling terminals and, thus, decreases the track's total cost of accepting wagers.

Although the embodiments of FIGS. 18-20 allow the patrons to focus on a specified number of runners, such as four, it will be apparent that the pari-mutuel gaming system may be configured to allow the patrons to focus on any number of runners from one runner to all of the runners in the race. Further, the number of betting options across the pools may be varied depending on the number of runners selected and the number of possible wagers. By allowing the patron to focus on a limited subset of runners, such as four, the patrons are able to understand and more efficiently review the various bet combinations and consciously make risk or reward decisions for each bet combination.

As further illustrated in FIGS. 18-20, the patron is presented with associated prices of the multiple bet options and does not have to perform an additional step of changing pools or reselecting runners. In existing betting interfaces, the patrons must structure each bet individually, review the price of the bet and make a decision on whether to purchase the bet, wherein the decisions occur on a pool-by-pool basis. Further, it can be difficult for patrons who cover a large number of bet combinations, such as bets including multiple runners in various positions of a Trifecta or Exacta wager, to end up with the intended combination coverage when the patron has to select and reselect runners across multiple pools. Since the runner selections made in the embodiments of FIGS. 18-24 are simultaneously applied to display multiple pools, the probability that the patron's desired bet combinations will be remembered and, thus, covered increases.

In a further embodiment of the runner-focused betting activities of FIGS. 18-24, the amount of the wager presented to the patron may be varied. Since the pari-mutuel gaming activities of FIGS. 18-24 provide for greater ease and efficiency of the patron placing wagers, the pari-mutuel gaming system may be configured to allow smaller denominations of bets. For instance, because the runner-focused betting methods allow for the efficient entry of a low cost wager, such as $0.10 (dime) bets, the patrons will likely enter more bets and, thus, the amount of the wager handle will likely not be negatively affected. Allowing smaller bets follows the trend seen in casinos where nickel slots have become prevalent, yet the amount of churn (i.e., the number of bets made) has increased. Although smaller bets may be offered, a minimum bet, such as $5, may be stipulated for any "ticket" or bundle wager. In this manner, the amount of wager handle may be kept constant by using the embodiments of FIGS. 18-24 since the patrons may enter exotic wagers as quickly as simpler wagers. Thus, although it would take a lot of time using existing bet interfaces to enter a sufficient amount of $0.10 Trifecta wagers to spend the $5 minimum wager, the simultaneous presentation of multiple pool bet options enables the patron to rapidly make a number of bets that apportion the $5 minimum bet.

A pari-mutuel gaming activity using previously indicated runners is disclosed in another exemplary embodiment. In this embodiment, the gaming terminal, or electronic betting interface of the pari-mutuel gaming system, is configured to aid a patron in placing wagers on runners previously selected and wagered on by the patron. For instance, if a player purchased a winning wager on a specific runner, such as a #5 horse, and then selects an Exacta wager, the betting interface will indicate that the #5 horse was previously selected, thus, reminding the patron that the #5 horse is a favored runner of the patron. If the betting interface is organized in a format where runners are selected simultaneously with the positions of the runners, intelligence may also be applied to indicate the runners in a logical position based on previous wagers. For example, runners selected for a straight Win, Place or Show pools might be indicated as logical selections in all three positions of a Trifecta wager, wherein runners selected for the second and third positions in the Trifecta would be indicated in the Place and Show positions, respectively, of the Win, Place, Show pool area of the betting interface.

The indicated runners embodiment offers experienced players and novice players a convenience by helping to structure and enter wagers for previously selected runners from multiple pools. By indicating runners, the amount of time required to place wagers from multiple pools is decreased and, thus, the wagering handle may be increased. The indication of favored runners may be accomplished in a variety of ways. Referring to FIG. 25, there is shown one embodiment of a screen generally at 100 used to indicate favored runners. A flag 102 is placed on buttons of previously selected runners and a button 104 is illustrated as having different shading than nonselected buttons. In other embodiments, the buttons of the previously selected runners may be selected by highlighting with color, changing the format of the buttons, marking with an indicia other than the flag 102, or combinations of any thereof.

Quick Bets

In a further exemplary embodiment referred to herein as an "intelligent quick pick," a patron is provided with an opportunity to place a wager on a pari-mutuel gaming activity. The intelligent quick pick allows a patron, or player, to place a nonrandom wager, in whole or in part, wherein any or all elements of the nonrandom wager, i.e., track, race, amount, pool, runner, and combinations thereof, are not deliberately selected by the patron. Instead, a portion of the wager, i.e., a particular track, a specific race, an amount of money of the wager, one wager of a pool of wagers, at least one runner of the list of runners, or a combination or more than one of these parameters is selected by software of the pari-mutuel gaming system and the wager is communicated to the player such that the player may select the wager based, at least in part, on the displayed portion of the wager. In the exemplary embodiment, the patron may or may not know the details of the displayed portion of the intelligent quick pick wager when the wager is selected. For instance, if the patron does not know the runner of the intelligent quick pick wager, the patron may know the rationale or basis for the selection of the runner by a title of the intelligent quick pick wager, an explanation of the rationale of the intelligent quick pick wager, or by associating the rationale of the intelligent quick pick wager with a particular type of handicapping personality. As used herein, "handicapping personality" refers to a method or approach of identifying a desirable runner or using a criteria to establish an identity for selecting a desirable runner.

Pari-mutuel betting is an inherently competitive activity for many patrons and, unlike a lottery, slot machines and most casino games, the relative skill of the pari-mutuel patron can greatly affect his/her overall return on their investment. While known random quick picks are easy to select, they do not provide the patron with any control over runner selection, and the fact that true random quick pick selection ignores traditional handicapping methods deters some patrons from playing the random quick picks. However, the intelligent quick picks described herein enable the patron to quickly place a wager and retain some control or knowledge of the rationale for the basis of the intelligent quick pick selection. Further, the patron's knowledge of the rationale behind intelligent quick pick wagers will foster a sense of confidence and control in making such wagers and will increase satisfaction and pride when the patrons win. Intelligent quick pick wagers also create opportunity for placing wagers on future wagers according to specified criteria. For example, a patron may request that the tote system place $2 win wagers on future intelligent quick picks associated with a particular handicapping personality. In this way, the ease with which a patron can wager either onsite or offsite is greatly increased.

Those in the pari-mutuel gaming industry believe that the attraction and recruitment of new patrons to pari-mutuel gaming is difficult due to the complexity of the wagering process. For instance, the sale of Daily Racing Forms including pages of data on runners' past performances combined with the complexity of the wagering process may deter or overwhelm new patrons. A further deterrent to continued wagering by new players occurs when novice patrons realize that they are betting against experienced players at a perceived disadvantage. The intelligent quick picks described herein help lower this perceived barrier to new patrons since the intelligent quick picks help educate the new patrons on the various aspects of selecting runners and wagering options in the pari-mutuel gaming activity. For instance, aspects or factors that can be used to select runners for the intelligent quick picks include, but are not limited to, speed, class, form, jockey, pace and various combinations thereof. Intelligent quick picks may be designed to include these factors, which in turn can be communicated to the patrons, thus helping educate new patrons on the sport and the possible betting strategies of pari-mutuel wagering.

Figure 26:
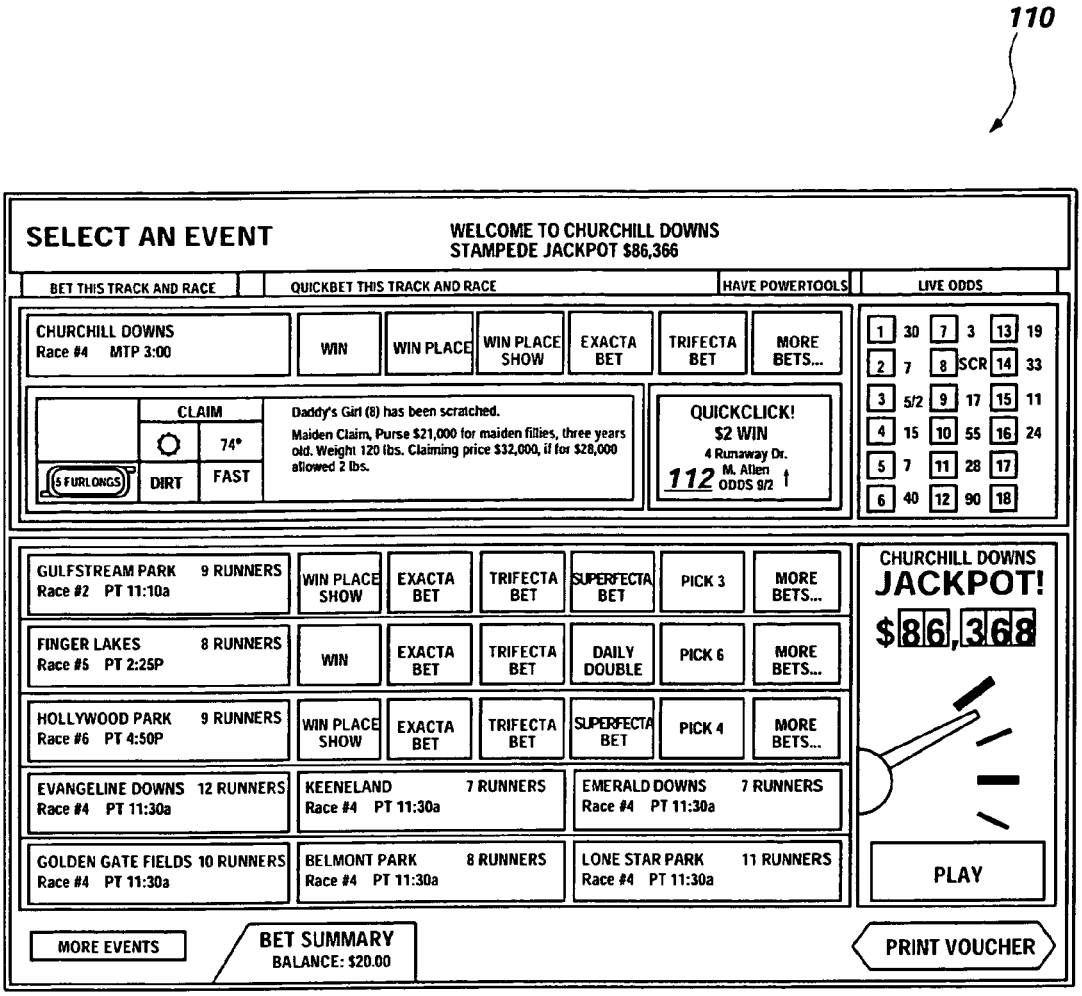
FIG. 26 illustrates a screen of an embodiment for presenting a complete intelligent quick pick wager.

The intelligent quick picks may be implemented and executed in a number of ways and located on various areas of a betting interface or wagering terminal. One exemplary embodiment of a screen is shown generally at 110 offering a patron with an opportunity to place a wager on a complete intelligent pick wager in FIG. 26. The screen 110 of FIG. 26 provides the patron with an opportunity to buy a complete intelligent quick pick wager by making a single selection on the illustrated betting screen 110. By selecting a single button 112, which in the exemplary embodiment is marked with indicia reciting "QUICKCLICK! $2 WIN," the player makes the wager. In the illustrated intelligent quick pick wager of FIG. 26, the runner selection is revealed to the patron, but the underlying rationale for the selection, though it exists, is not communicated to the patron.

Figure 27:
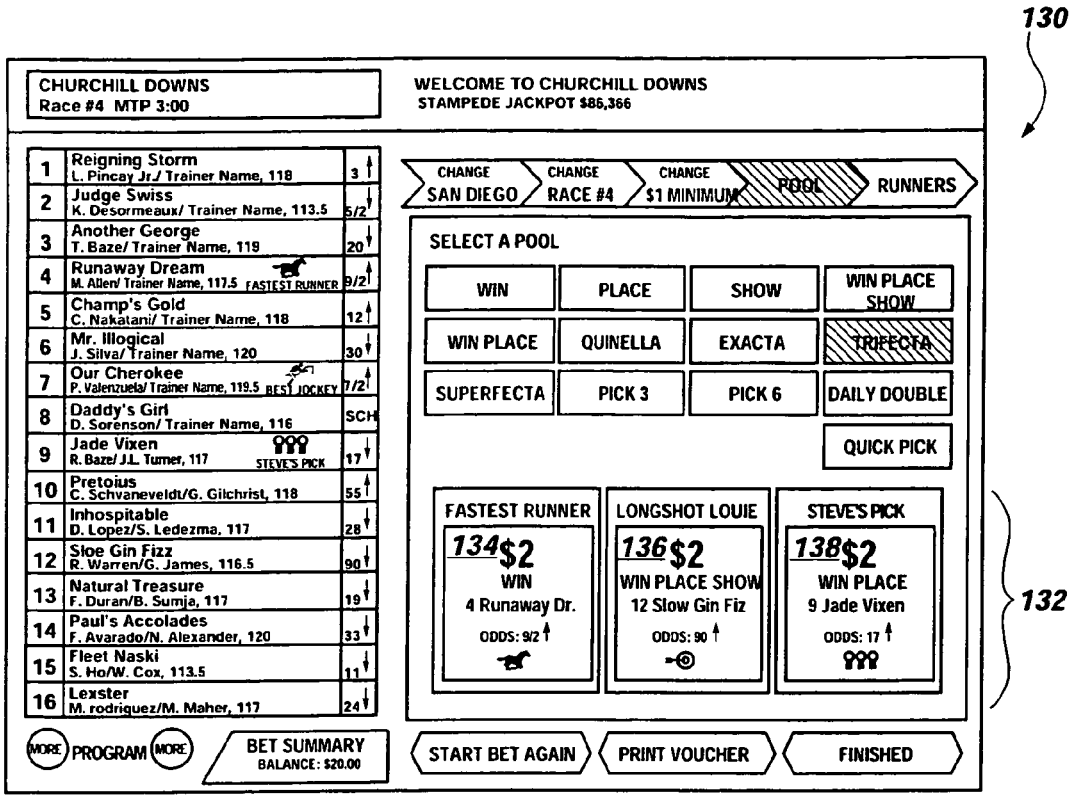
FIG. 27 depicts a screen offering an intelligent quick pick based on handicapping personalities.

In another exemplary embodiment of an intelligent quick pick, handicapping personalities are used to communicate the rationale for the intelligent quick pick to the patron. Referring to FIG. 27, there is shown a screen generally at 130 offering an intelligent quick pick based on handicapping personalities. The screen 130 offers three different quick picks at bracket 132. For instance, a patron can place a two dollar Win bet on the runner with the best overall speed rating by selecting a button 134 that corresponds to "FASTEST RUNNER." The "FASTEST RUNNER" selection may be based on past performance data of the runners for the race in question as stored in the pari-mutuel gaming system. In another exemplary embodiment, the number and name of the runner may be withheld from being displayed until the wager is placed to make the bet easier or to prevent patrons from discovering desirable picks without paying for the service.

In a further exemplary embodiment, a player can make a "LONGSHOT LOUIE" quick pick by selecting button 136. The "LONGSHOT LOUIE," wager may be based on tote data of the runners stored in the pari-mutuel gaming system overlaid with a handicapping personality using an algorithm. The algorithm used to determine the "LONGSHOT LOUIE" wager will be the same for all wagers, but the result of the wager may vary over the time span of the betting period, based on tote data stored in the pari-mutuel gaming system. In another exemplary embodiment, a player may select a "STEVE'S PICK" wager by selecting button 138, wherein the "STEVE'S PICK" wager may be based on an individual's selection such as, for example, a track handicapper, which may also be referred to as an intelligent quick pick. The algorithm used to determine the intelligent quick pick wager may be based on past performance data, tote data or an individual's selections. In yet another exemplary embodiment, the patrons may be provided with an opportunity to select or construct their own algorithms for a wager, using one or more parameters as described herein. The intelligent quick pick wager may be based on, for example, at least one of past performance data, tote data, a professional handicapper, or any combination thereof. The three types of intelligent quick pick wagers may also be combined into a single algorithm or the three types of intelligent quick pick wagers may be offered individually.

In an additional exemplary embodiment, the gaming terminal or other betting interface offering the complete intelligent quick pick may be operatively configured for future betting wherein a patron can establish a "subscription" for the programmed, automatic entry of wagers based on intelligent quick pick algorithms. It will be apparent to those of ordinary skill in the art that the number of methodologies or algorithms that may be used to create the intelligent quick picks is almost limitless.

In further exemplary embodiments, the pari-mutuel gaming system may be configured to display quick picks of betting pools of more exotic wagers including, without limitation, Trifecta, Exacta and Superfecta wagers, wherein a rationale for selecting the wager is presented to the patron. For instance, an intelligent quick pick offering a Trifecta wager on the runners with the best speed figures may be offered to the patrons. Further, an intelligent quick pick that combines a high price exotic wager with a Show bet may be offered to increase the frequency of wins for the patron and increase churn. In this manner, novice patrons may be enabled to place the exotic wagers that they otherwise may not understand.

In yet further exemplary embodiments, intelligent quick picks may be offered that include an amount of a base wager. In this manner, the requirement for the patron to first select the wager amount is removed. The patrons are able to see the total cost of the wager, and will understand and feel more comfortable exploring various wager types as the patron becomes educated as to the total cost of the wager. For instance, a $2 base bet on a Win/Place/Show wager on the #2 runner that equals a total of $6 may be displayed to the patron. By selecting the amount of the wager and presenting the wager amount to the patron, complex pricing schemes (for example, a minimum bet amount may be $2 for a Straight Trifecta while a minimum base wager for a Partial Wheel Trifecta may be $1) that exist in various jurisdictions are communicated to the patron.

In exemplary embodiments of the intelligent quick offered at an OTB parlor where races continually go off in rapid succession, a quick pick wager that offers an Exacta Box wager on large field races may be offered. For instance, by selecting a single button, the pari-mutuel gaming system would automatically place an Exacta Box wager on the horses ridden by the three best jockeys in the next race that includes ten or more runners for the patron. The determination of the identities of the three best jockeys may be performed by an algorithm combined with data stored in or accessed by the pari-mutuel gaming system, wherein the three best jockeys are determined by, for example, which jockeys have the highest frequency of riding a runner that finishes in the money. As previously discussed herein, there may also be an opportunity to allow patrons to create their own algorithms, wherein the algorithms are executed by software that evaluates tote and other data of the pari-mutuel gaming system.

In another exemplary embodiment, the pari-mutuel gaming establishment may charge a fee to patrons to offer the intelligent quick picks. Since the intelligent quick picks add value in terms of control and expected profit for the patron, the pari-mutuel gaming establishment may want to gain additional revenue in conjunction with the service, or offer the service for free or at a reduced cost to favored patrons, such as members of a club.

In a further exemplary embodiment of the intelligent quick pick referred to as a "partial pick," a portion of the bet selection is established by the pari-mutuel wagering system applying intelligence combined with patron selection. For instance, as illustrated on screen 150 of FIG. 28, the patron may make a Trifecta wager and populate the first, second and third positions of the Trifecta wager by selecting "FASTEST RUNNER," "BEST JOCKEY," "MOST IN THE MONEY" or pick a random selection using buttons indicated by bracket 152. In another wager, the patron may know that he/she likes the #1 and #3 horses for the first position of the Trifecta wager, and the patron could use the buttons 152 at the bottom of the screen 150 to add the "MOST IN THE MONEY" jockey to the second position of the Trifecta wager. In this manner, the intelligent quick pick may be used to construct a portion of the wager while the patron constructs the remaining portion of the wager by making a selection.

Figure 28:
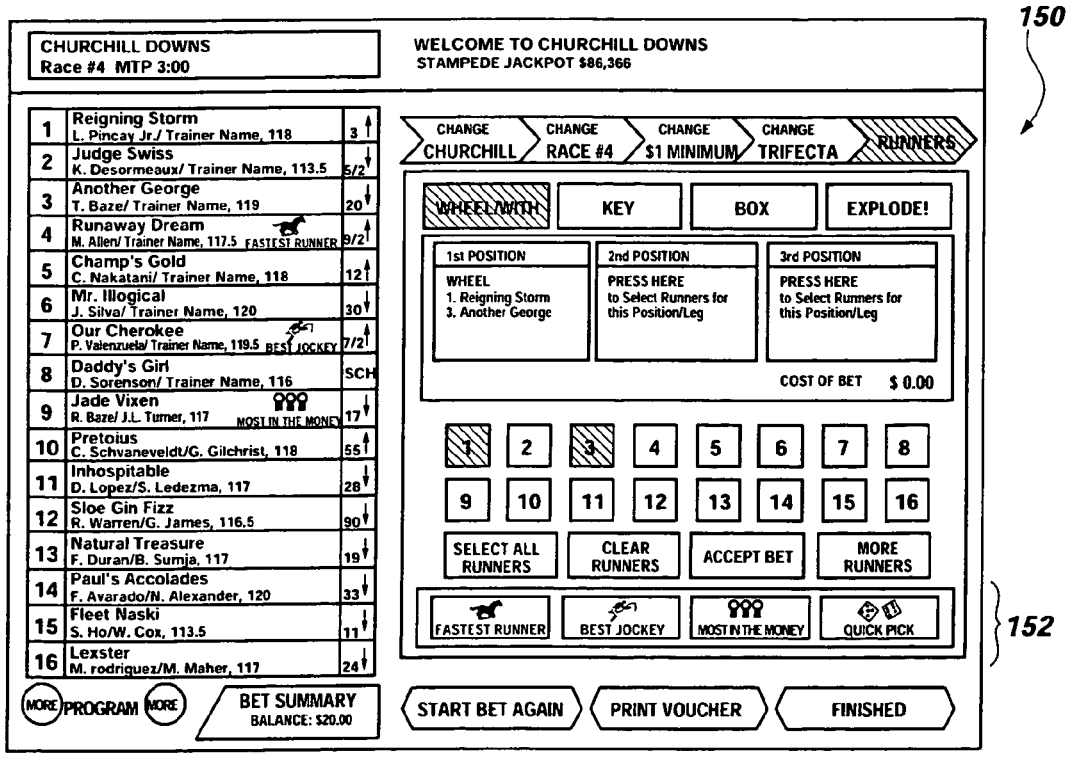
FIG. 28 is a screen depicting a partial pick embodiment of a quick pick.

In another exemplary embodiment of the present invention referred to as "wager add-ons," the complete intelligent quick pick of FIG. 27 or the partial pick of FIG. 28 may be used to construct multiple wager bundles where one wager, or a portion of one wager, is deliberately constructed and another related or unrelated wager is "added on" to the patron's wager selections. For instance, a patron that places an Exacta bet on the #1 and #3 horses might be presented with an additional opportunity to place a 1-3-9 Trifecta wager. The addition of the #9 horse for the third leg of the Trifecta wager could be based on tote data (i.e., the probable highest payout Trifecta using the 1-3 in the first two positions), past performance data (i.e., an algorithm that finds a runner with similar characteristics or past performance ratings similar to the two deliberately selected runners), or on betting behavior data (i.e., an algorithm that inspects betting patterns of patrons and suggests the third runner because the third runner is most frequently paired with the other two runners on other tickets). Although the add-on wagers are not placed as rapidly as the complete picks, many of the same benefits, including the patron making impulse bets, are achieved.

In another exemplary embodiment, the partial intelligent quick picks may be programmed for future betting. In this embodiment, a patron is provided the opportunity to establish "subscriptions" to automatically place wagers in future races based on the patron's deliberate selection(s) in conjunction with quick pick algorithms. For instance, a patron who repeatedly places wagers on runners having the same runner numbers may set up, or program, a subscription to make future bets on selected races to place three runner Exacta Box wagers, wherein the numbers patron determines that a #1 and #5 horse are always selected and a post time favorite is included into a Trifecta wager. In the exemplary embodiment, the post time favorite selection is based on a quick pick algorithm—the runner with the lowest pari-mutuel odds in the win pool at post time.

The exemplary embodiments of the quick picks described herein may include set or inferred preferences. The intelligent quick picks may be offered in order to anticipate a patron's betting patterns where the pari-mutuel gaming system is operatively configured to present wagers that are more likely to appeal to the patron. For instance, if a pari-mutuel gaming establishment knows that a large group of novice patrons will be coming to the establishment, the pari-mutuel gaming system may be operatively configured with suitable software to offer quick pick wagers that the novice patrons are more likely to select, for example $1 exacta box wagers.

One Action Quick Bet

Figure 29:
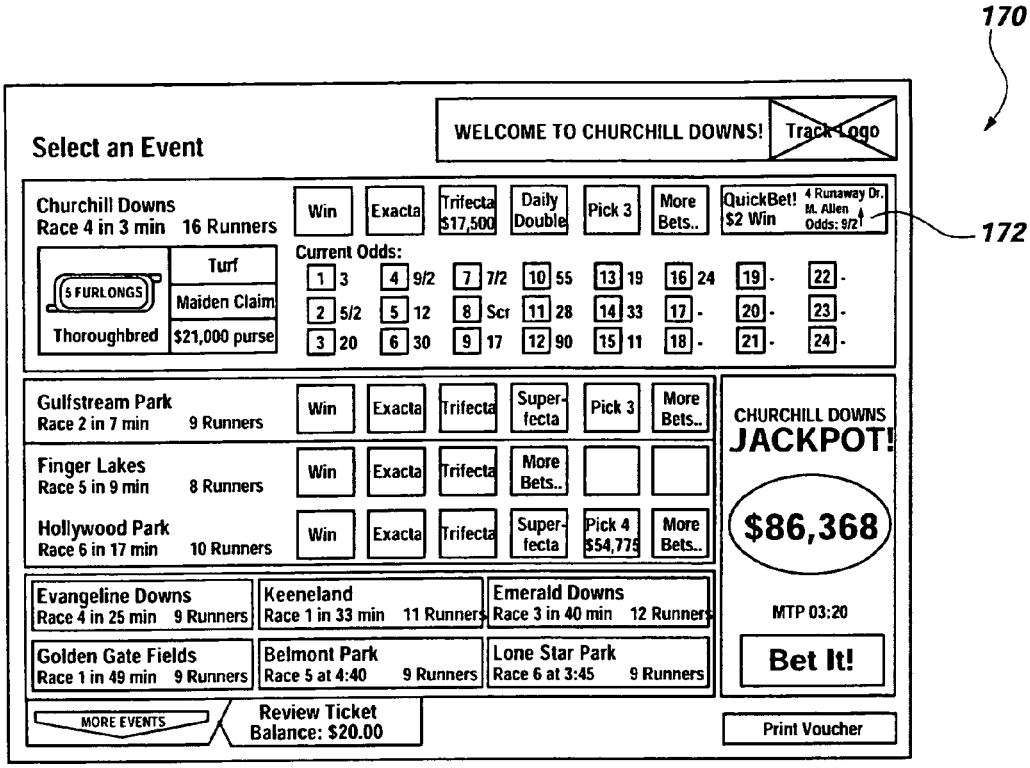
FIG. 29 illustrates a screen providing one embodiment of a one action quick pick bet.

Referring to FIG. 29, there is illustrated a screen 170 of another exemplary embodiment of the present invention where a patron is provided with an opportunity to place a "one action" quick bet. The screen 170 is presented to a patron at a self-service betting terminal when the patron approaches the terminal or to a teller at a full-service betting terminal. A button 172 located in an upper right hand corner of the screen 170 allows the patron or the teller to place a wager by making a single selection. The single selection selects the track, race, amount of the wager, pool and runner(s) all in one action such that no other action is needed. The one action quick bet may be based on random, partially random or intelligent quick picks as previously described herein. The one action quick bet is faster and easier to place than existing wagering methods and saves terminal time and costs for the pari-mutuel gaming establishment. Further, the one action quick bet enables novice patrons to more easily place a wager, increases impulse betting, and increases overall wager handle at the pari-mutuel gaming establishment.

Intersection Betting

Figure 30:
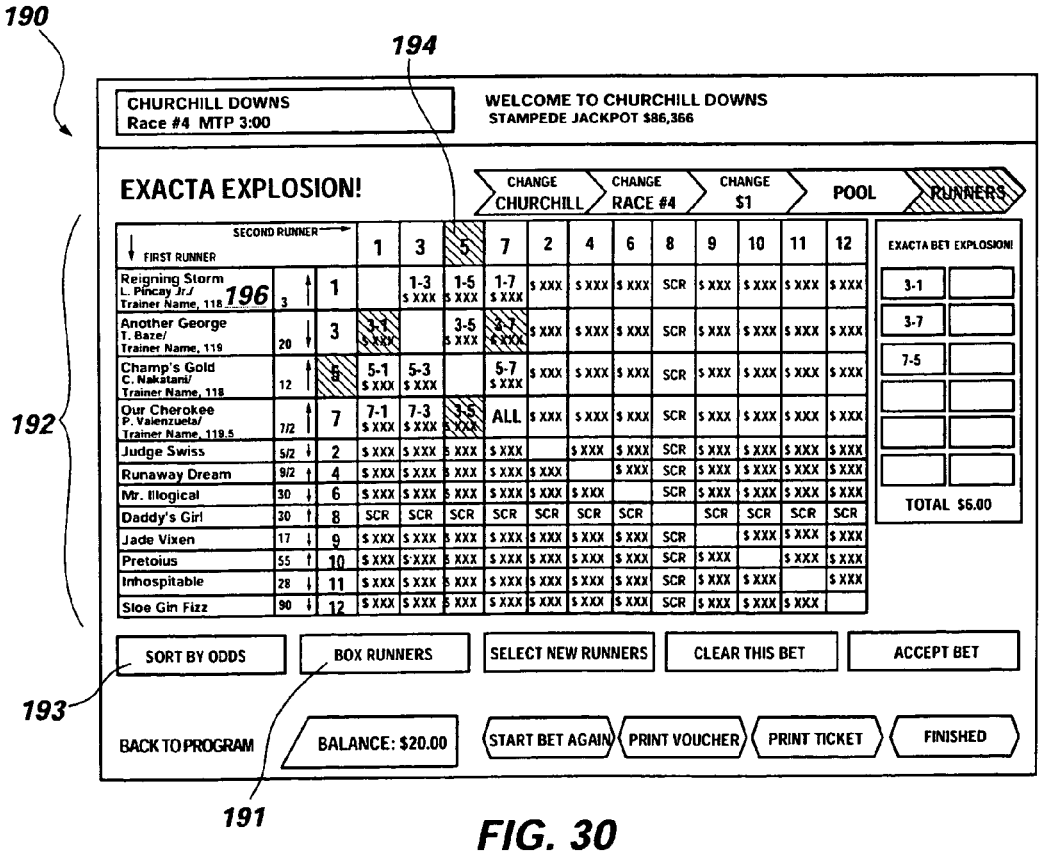
FIG. 30 depicts a screen of a gaming terminal presenting a table of one embodiment of an intersection betting and review activity.

In yet another exemplary embodiment, a method of presenting pari-mutuel betting options or indicating bet selections referred to as "intersection betting and review" involving multi-leg wagers (such as a Daily Double) or multi-position wagers (such as an Exacta) is disclosed. In this exemplary embodiment, a patron is allowed to select runners for at least two legs or positions simultaneously with one selection. A screen is illustrated generally at 190 for providing a player with an opportunity to place a wager in this manner in FIG. 30. The screen 190 presents the player with a table 192 that includes the runners of one leg or position in columns 194 and the runners of another leg or position in rows 196. The player can select a runner combination by selecting a cell where one of the columns 194 intersects with one of the rows 196. The player may also select entire rows or entire columns by selecting at least one of a row or column header, thus creating wheel wagers. For instance, the player may select the entire column indicated with the cell with shading at column 194 by selecting the cell with the header "5," or the player may select the entire row indicated with the cell reciting "Reigning Storm" at row 196 by selecting that cell. The table 192 may be configured to accept wagers for single race pools such as Exactas, Quinellas, Trifectas, Superfectas, Hexafectas, Pentafectas, and the like, or for multiple race pools such as Daily Doubles, Pick 3's, Pick 4's, Pick 6's, etc. In will be apparent that the player may select an entire column 194 or an entire row 196 by selecting the cell having a header.

The player may be provided with an opportunity to make selections for greater than two leg or position pools, such as a Trifecta, in a number of different methods. In a first method, the player selects a first runner position of the wager and is shown the table 192 including columns 194 and rows 196 of runners in order to select the runners in the second and third positions. This first method may also be used in conjunction with other pools. For instance, a Pick 6 wager could be made by allowing a player to preselect the first four runner positions, and presenting the fifth and sixth runner positions in the columns 194 and rows 196 of the table 192. A Trifecta wager may be made using the table 192 by "freezing" a position and presenting the table 192 to the patron. For instance, a player may select a runner in the first or third position of the Trifecta, and the player is presented with the second and third positions or first and second positions, respectively, situated in the columns 194 and rows 196 of the table 192.

The table 192 used to present the intersection betting and review to the players is efficient and presents relevant value statistics and a graphic representation of pool coverage to the players. The table 192 also facilitates the rapid entry of multiple wagers. For instance, a patron wishing to place multiple "straight" Exacta wagers (e.g., 1-2, 2-3 and 3-4) using known betting methods would have to complete at least two stroke selections per wager: one stroke for selecting the runner in the first position and a second stroke for selecting the runner in the second position, resulting in a total of six strokes to place the three Exacta wagers. By presenting the patron with the table 192 of FIG. 30, each of the three Exacta wagers may be placed with one stroke by selecting a cell where the column 194 and the row 196 of the desired runners intersect, resulting in a total of three strokes.

By presenting the betting interface of the screen 190 in the table 192 format, a logical place for presenting relevant value statistics, or probables, to the patron exists. For instance, in the Exacta betting screen 190 of FIG. 30, the probables for each runner combination of the Exacta can be presented in the intersection cell of the column 194 and the row 196. By presenting the probables in the selectable area of the table 192, betting is made easier since the patron does not have to view an Exacta probables matrix and separately enter bets using known betting methods. The table 192, thus, increases patron satisfaction and increases the likelihood of impulse wagers when patrons opt to wager on high probables or identify relative value overlays on the betting screen 190. The patron may also "Box" all selected runners by pressing the "Box Runners" button at 191. The player may also sort the runners by odds by pressing the "Sort by Odds" button at 193, thus placing the runner combinations or "cells" with the highest probable prices in the upper left hand portion of the table 192.

Since patrons are often upset or disappointed when they fail to wager on a logical runner selection that ultimately wins, the presentation of betting options in the table 192 allows the patron to visually grasp the results of the runner selection by indicating which runner combinations have been selected. Thus, in another exemplary embodiment, the screen 190 is configured to indicate, by formatting with color, highlighting or some other indicia, the selected runners. For instance, if the patron selected runners for the first position and the second position, the cell at which the column 194 and rows 196 intersect is formatted to display the cell in a manner such that the player will know which runners or cells were selected. The formatting of the runners, positions or wagers selected by the patron may also be applied to Wheel and Box wagers, wherein each of the relevant intersections of the cells of the table 192 is formatted. The graphic representation of the various bet selections increases the patron's ability to see any overlooked runner combinations and, thus, increases the patron's satisfaction of the pari-mutuel gaming activity and increases the track wager handle. Further, the graphic representation of the various bet selections made by the patron may be implemented in any of the gaming activities described herein and in other known pari-mutuel gaming activities.

Rules-Based Methods

In an additional exemplary embodiment, rules-based methods for controlling the presentation of betting options are included. The rules-based methods may be used by organizations or pari-mutuel gaming establishments to control the presentation of betting options offered to patrons in a way that maximizes the patrons' gaming experience and the objectives of the organization. The rules-based methods allow the organization to set rules to customize and control various aspects of the graphical user interface presented to the patrons at the betting terminal.

In accordance with the present invention, organizations are enabled to control the appearance and content of wager or advertisement graphics presented to the patron on a screen of the betting terminal. For instance, the size, location, appearance, sort order, filtering, grouping or searching of the various wagers and advertisements presented to the patrons may be customized and controlled. User interface characteristics on the betting screens that may be controlled include, without limitation, track selection, race selection, pool selection, wager amount, a money amount of the total wager selection (i.e., the base wager amount times a base wager quantity), and special marketing messages and functions.

Figures 31, 32:
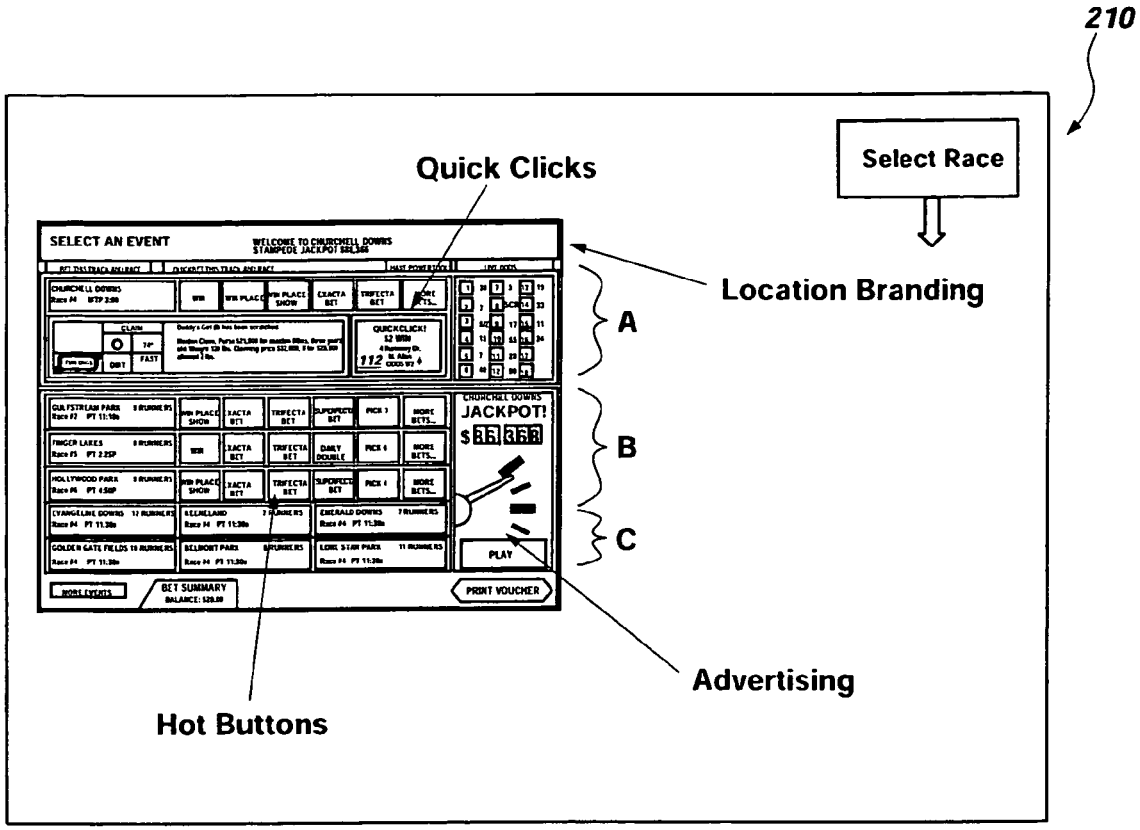
FIG. 31 is a screen of a gaming terminal implementing one embodiment of a rules-based method displayed to a patron.
FIG. 32 illustrates one embodiment of a screen of a menu of rules presented to an organization controlling the gaming terminal of FIG. 31.

Referring now to FIG. 31, there is shown a selection screen generally at 210 for implementing one embodiment of a rules-based method for controlling the presentation of betting options with the pari-mutuel gaming system. In the exemplary embodiment, the race selection screen 210 specially highlights the next race at Churchill Downs. The rules-based method improves patron experience by allowing a track to configure the screen 210 presented to the patron with betting options in a way that makes it easier or more enjoyable for the patrons to place wagers. For instance, races, betting pools, and wager types can be prioritized and shown more prominently at the times most relevant to the patrons.

FIG. 32 illustrates an organization console in the form of a menu that allows the organization offering the pari-mutuel gaming activity to set the rules or customize the appearance of the screen 210 presented to the patron. By using the organization console of FIG. 32, the organization can assign eligibility to each area A, B or C as depicted in the screen 210 of FIG. 31. Thus, the organization may preset or allocate three or more levels of prominence on the screen 210 such as, for example, area A may more prominently present tote data and intelligent quick bets, area B may more prominently present hot buttons, and area C may present other tracks. The organization console also allows the organization to set a "leap frog" value that moves a race up to the next higher level despite a raw Minutes to Post sorting. For instance, if the organization determines that a particular race should be highlighted or featured, wagering options for the featured race may be displayed to patrons before other races that are closer to Post, thus, "leap frogging" the races that are closer to Post. It will be apparent to those of ordinary skill in the art that the rules or elements that may be customized in FIG. 32 are just one of many ways in which a rules-based prioritization of betting options can be implemented.

By using a console or other display element similar to the screen 210 of FIG. 32, a track or organization may create and apply rules to maximize betting on various preferred wager types. For instance, if a track felt that it made more money on Trifecta wagers due to a larger takeout percentage, the track might set rules or customize the betting options and present "hot buttons" to the players, wherein the hot buttons increase the prominence of Trifecta wagering options on the screen. For example, to increase the prominence of Trifecta wagering options, the organization or track might focus attention on the pool itself by setting a Trifecta quick pick as a "hot button" or by bundling wagers from multiple pools to include a Trifecta bet. In one embodiment, the track may display their own graphic on the betting interface and include an area, such as a selectable button, in the graphic. By selecting the area, patrons may be able to automatically select the track and race, wherein options to finish a wager are also presented. This embodiment may be useful for advertising Pick 6 carryovers and enable the track to channel betting.

In another method of setting wagering preferences, the track or organization may set a default wager amount on a particular wager or increase the average bet amount in other areas of the user interface or wager terminal. For example, although a minimum bet at a track may be $1, the track or organization may set the user interface or wager terminal to display the Win wager at a $5 bet as a default. Thus, players would be more likely to make the $5 bet instead of changing the wager terminal to display a $1 bet.

In other exemplary embodiments of the rules-based method, the organization may create and apply rules to maximize betting on preferred events or races. For instance, since Churchill. Downs Incorporated (CDI) makes more profit on each wager sold for a CDI property (Arlington, Calder, Hollywood, Churchill, etc.) than for imported, non-Churchill simulcast races, the rules-based method enables CDI to channel betting towards the CDI properties by increasing the prominence of CDI races presented to the patrons on the wager terminal. Even a small shift in betting towards properties owned by the organization can result in a large increase in profit.

In yet a further embodiment of the rules-based method, the organization or track may apply rules to customize the displays of the wager terminal to determine when to show various advertising graphics or control the functions available to the players through the player's selection of the graphics. In one embodiment, the track might configure the wager terminal to display advertisements that promote players to signup for a club reward program offered by the track. By activating an area of the advertising graphic, the player may be taken to a screen where the player may sign up for the club reward program. Similarly the advertising area may include a graphic that, when selected, would move the patron through the wagering process, either in part or in whole on a desired race. For example, the graphic may advertise a large Pick 6 carryover and selecting the graphic would initiate placement of a wager on the Pick 6. In other embodiments, the track or organization may sell advertising areas presented on the user interface to vendors such as Coca-Cola or Budweiser, thus generating additional revenue for the track. In a further embodiment, pool carryovers or "jackpots" such as, for example, a Pick 6 carryover are shown on hot buttons to attract attention and, thus, increase wagering.

String Betting on a Self-Service Interface

In another exemplary embodiment, a method for patron placement of multiple multi-position (exacta, trifecta, etc.) and multi-leg (pick 4, pick 6, etc.) wagers without reselecting a pool or requiring a stroke to accept each wager individually is disclosed. To offer string betting on an electronic interface, the patron is presented with a button or an area of a betting interface, i.e., the screen, named "string." If the patron selects this button, he or she may enter multiple wagers without reselecting the pool or confirming each wager individually. For example, to place three straight Exactas he or she could press "string" 1 with 4 with 5, 4 with 5 with 1, 1 with 6 with 4. This method allows bettors, especially experienced ones, a great convenience.

Subscription and Programmed Betting

In another exemplary embodiment, methods of offering subscription, including, without limitation, programmed betting to patrons at a pari-mutuel gaming site are disclosed. To offer subscription betting with an opportunity to select or program parameters associated with wagers to be made, the patrons are presented with an opportunity to set rules or customize an automatic placement of future wagers for upcoming races that are scheduled to be run. The patrons are allowed to select definite wager details for a track, a race, an amount of the wager, one or more runners, a pool, or combinations thereof if desired. In one embodiment of executing subscription betting, a player is able to set, or program, parameters on a betting terminal of a pari-mutuel gaming system to place a $1 Trifecta box wager on 1/5/6 when available at Churchill Downs.

In another embodiment of subscription betting including an opportunity to at least partially program the bet, the patrons are presented with an opportunity to set criteria based on a variety of factors that are not directly related to the actual details of the wager. The factors may include, but are not limited to, tote data, past performance data, track conditions, race details, or combinations thereof. In one embodiment, a patron may create rules or customize wagers to be placed under selected conditions. One condition may be a tote data rule where the player places a $2 Exacta Box wager on the favorite and the long shot on any race having more than ten runners at Churchill Downs. Another condition may use past performance data, such as where a $10 wager to Win is placed on the horse with the fastest time at a distance of the horse's moving down in class. A further condition may be based on track conditions, wherein a patron places a $2 wager to Show on the long shot when the track conditions are sloppy. Another condition may take into account race details such as where a patron places a $10 wager to Win when a specific jockey, such as Jerry Bailey, is riding a horse trained by Bob Baffert. For a subscription betting system to be employed, a pari-mutuel gaming system configured to present the subscription betting will use named or unnamed patron accounts to fund the wagers and the pari-mutuel gaming system is configured to react to last minute changes in runners, such as if a runner is scratched from the race. If the condition designated by the player does not occur, such as if a runner scratches, the wager may be canceled or the wager may be implemented on the next race matching the criteria, or rules, set for the wager.

By presenting players with the opportunity to place subscription bets including a programming feature, the player is provided with the convenience of participating in future races without having to place each wager on every race individually or wait until betting opens on those races. If the player is at the track, the player can establish his/her theory for betting and know that the wager will be automatically placed on a selected number of races, or a selected number of times. If the player is offtrack, the player can participate in the betting action without having to log onto an Internet betting site or make a phone call each time a wager is desired since the bets are automatically placed. In addition to the day-to-day convenience, this greatly simplifies the process for placing wagers on important racing events like the Kentucky Derby. Currently, pools must be open for a patron to place an order for a bet. Generally, the Kentucky Derby pool does not open until the morning of the race, so bettors must place their bets the day of the Derby. When races that the player placed the subscription bet on have been completed, the player may be notified of the wager and result of the race by a text message, voice message or other suitable communication.

Since players may have difficulty in sticking with their betting system in lieu of the different possible wagering opportunities, the subscription betting method allows players to set rules or customize their subscription bets in accordance with the player's own betting system. Thus, the player can commit to a betting system. Since subscription betting comprises about 15% of lottery purchases, presenting a player with an automatic way to place wagers in advance and according to selected parameters or methodology will likely increase on track and offtrack betting and, thus, increase the handle of the pari-mutuel gaming establishments. Further, since the subscription bets are set up once by the player and result in multiple wagers being placed, the tracks will need fewer account wagering telephone operators, self-service terminals and tellers at the track to process/enter bets. Thus, the track may experience a reduced operating cost. To produce an additional revenue stream, the track or organization may charge a fee to patrons for, for example and not by way of limitation, at least one of the establishment, execution and ongoing activation of the subscription as well as programmed bets or provision of ancillary services like text or audio messaging.

Figure 33:
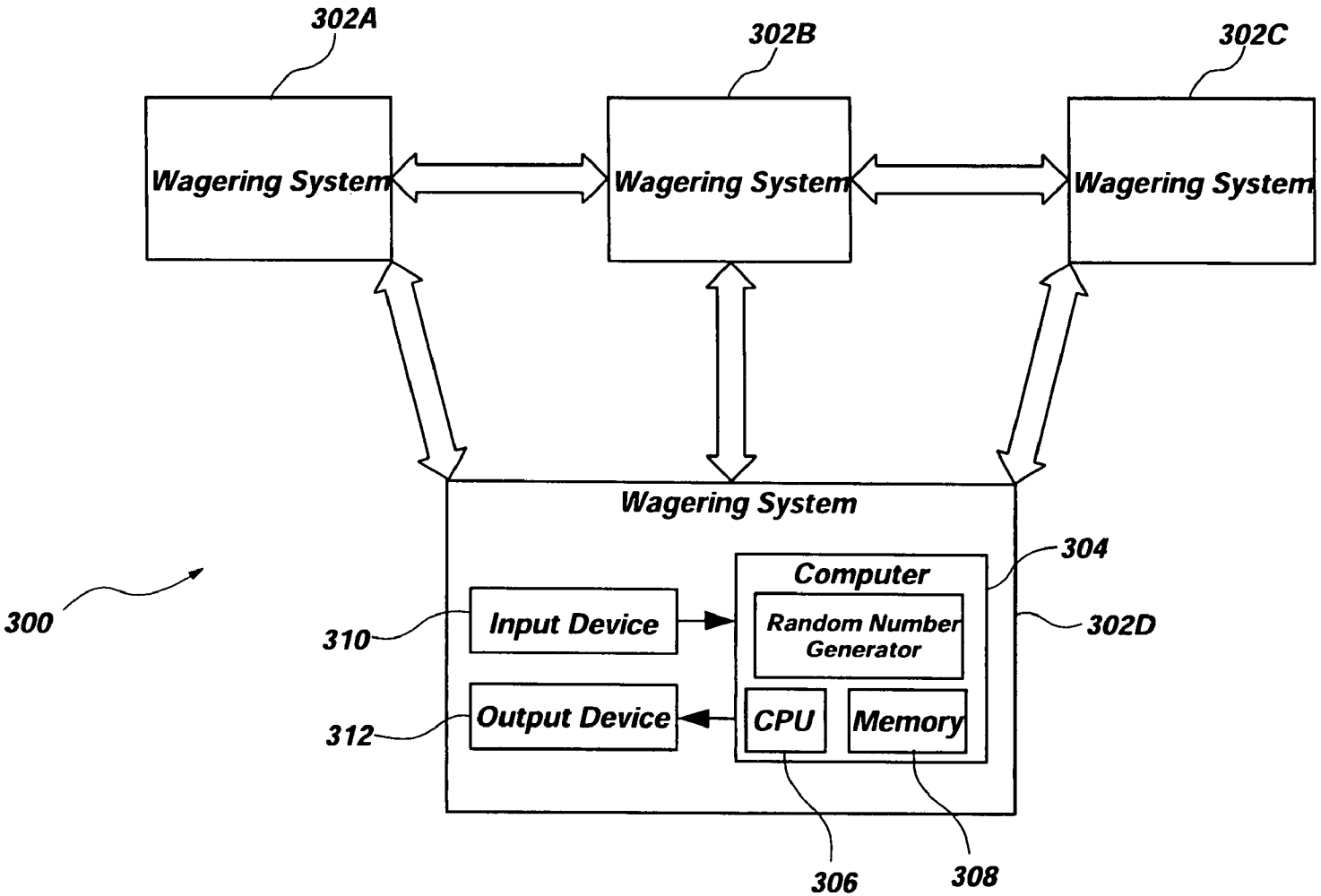
FIG. 33 is a schematic of a wagering system and network which may be used in accordance with the pari-mutuel gaming activities described herein.
Figure 34:
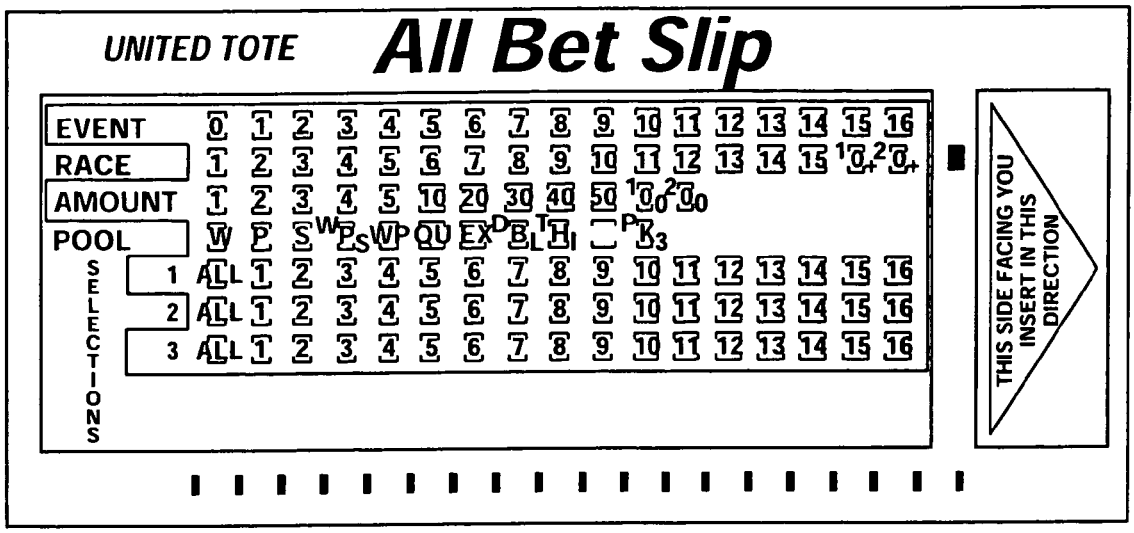
FIG. 34 is a copy of a printed bet slip.

Referring now to FIG. 33, a network 300 for conducting the pari-mutuel gaming activities described herein is illustrated. The network 300 may include a plurality of pari-mutuel gaming systems 302A-302D (collectively identified herein as "systems 302") which are operably coupled to one another. Each system 302 may include, for example, a computer 304 with a central processing unit (CPU) 306 or other processing device and associated memory 308. Each computer 304 may be configured with software that enables the computer 304 to conduct the pari-mutuel gaming activities described herein. An input device 310 may be coupled with the computer 304 to interact with players and patrons and receive selections of the players and patrons. The input device 310 may further include a device for accepting a monetary value associated with a pari-mutuel wager wherein the device may include, for example, a coin collector, a bill collector or a card reader. An output device 312 may also be coupled with the computer 304 and configured, for example, to display the pari-mutuel gaming activities described herein. Such an output device 312 may include, for example, a visual display and/or a printing device. Additionally, such an output device 312 may be configured to display the results of a pari-mutuel gaming activity taking place at a remote venue. Thus, for example, a first pari-mutuel gaming system 302A may be located at a first venue while another pari-mutuel system 302D may be located at a second remotely located venue. Thus, the network 300 formed of the plurality of pari-mutuel gaming systems 302A-302D may enable wagering on, and monitoring of, pari-mutuel gaming activities at multiple venues simultaneously, if so desired. In another embodiment, the pari-mutuel gaming systems 302A-302D may be located at a single venue where, for example, a first pari-mutuel gaming system 302A acts as a server while other pari-mutuel gaming systems 302B-302D act as terminals coupled with the gaming system 302A.

The exemplary embodiments described herein are not intended to limit the invention or the scope of the appended claims. Various combinations and modifications of the embodiments described herein may be made without departing from the scope of the present invention and all modifications are meant to be included within the scope of the present invention. For instance, various embodiments of the pari-mutuel gaming activities described herein may be used in conjunction with other embodiments of the pari-mutuel gaming activities described herein. Further, the pari-mutuel gaming activities described herein may be implemented by suitably configuring software or hardware systems of pari-mutuel gaming systems and used in conjunction with existing pari-mutuel gaming systems. Thus, while certain exemplary embodiments and details have been described for purposes of illustrating the invention, it will be apparent to those of ordinary skill in the art that various changes in the invention described herein may be made without departing from the scope of the present invention, which is defined in the appended claims.

The invention claimed is:

1. A method of conducting a pari-mutuel gaming activity on a computerized pari-mutuel gaming system, the method comprising:

providing at least one patron an opportunity to select at least one runner from a list of runners on a display element with an input device coupled to a computerized pari-mutuel gaming system operatively configured with hardware and software;

responsive to the at least one patron selecting the at least one runner with the input device, providing the at least one patron an opportunity to place at least one first wager on a race wherein the at least one runner makes up a portion of the at least one first wager;

responsive to the at least one patron placing the at least one first wager and without any further input from the at least one patron:

preselecting the at least one runner with the computerized pari-mutuel gaming system;

thereafter, displaying on the display element the preselected at least one runner in at least one wager option including the preselected at least one runner, the at least one wager option different than the placed at least one first wager; and thereafter, providing the at least one patron with an opportunity to place at least one second wager on the race by selecting the at least one wager option on the display element with the input device; and displaying on the display element at least one indicia of a wager selected by the at least one patron.

2. The method according to claim 1, further comprising providing the at least one patron with an opportunity to place another wager on the race, wherein the another wager is not related to the at least one first wager.

3. The method according to claim 1, further comprising:

responsive to the at least one patron placing the at least one first wager, providing the at least one patron an opportunity to select at least another runner on the display element with the input device;

wherein the at least one wager option includes the at least one runner and the at least another runner.

4. The method according to claim 3, wherein preselecting the at least one runner with the computerized pari-mutuel gaming system comprises generating a pool of wager options including the at least one runner and the at least another runner; and wherein displaying on the display element the preselected at least one runner in at least one wager option including the preselected at least one runner comprises displaying the pool of wager options on the display element to the least one patron.

5. The method according to claim 4, further comprising marking an area of the displayed pool of wager options on the display element representing the at least one runner.

6. The method according to claim 1, further comprising displaying tote data on the display element in conjunction with at least one of the at least one first wager and the at least one second wager.

7. A system for conducting a pari-mutuel gaming activity, the system comprising:

a display element for displaying information associated with a pari-mutuel gaming activity;

an input device for interacting with at least one patron;

a computer operatively configured with software;

wherein the software is operatively configured to enable the computer to conduct the pari-mutuel gaming activity, wherein, in the pari-mutuel gaming activity:

at least one patron is provided with an opportunity to select at least one runner from a list of runners displayed on the display element;

the at least one patron is presented with an opportunity to place at least one first wager on a race displayed on the display element in response to the at least one patron selecting the at least one runner and wherein the at least one runner makes up a portion of the least one first wager;

without any further input from the at least one patron, the at least one patron is presented with at least one wager option different that, the placed at least one first wager, the at least one wager option including the at least one runner that is preselected responsive to the at least one first wager placed by the at least one patron; and thereafter, the at least one patron is presented with an opportunity to place at least one second wager on the race displayed on the display element by selecting the at least one wager option with the input device.

8. The system of claim 7, wherein the at least one wager option further includes at least one suggested runner to include in the second wager in addition to the at least one runner that is preselected based on the at least one first wager.

9. The system of claim 7, wherein the software is configured to enable the computer to:

provide the at least one patron an opportunity to select the at least one runner for the at least one first wager with the input device; and provide the at least one patron an opportunity to select at least another runner with the input device in response to the least one patron placing the at least one first wager;

wherein the at least one wager option includes the at least one runner and the at least another runner.

10. The system of claim 9, wherein the software is configured to enable the computer to generate a pool of wager options including the at least one runner and the at least another runner and display the pool of wager options on the display element.

11. The system of claim 10, where the software is configured to enable the computer to mark an area of the displayed pool of wager options representing the at least one runner on the display element.

12. The system of claim 7, wherein the software is configured to enable the computer to display tote data in conjunction with at least one of the at least one first wager and the at least one second wager on the display element.

* * * * *

UNITED STATES PATENT AND TRADEMARK OFFICE

CERTIFICATE OF CORRECTION

PATENT NO. : 8,292,729 B2
APPLICATION NO. : 10/727154
DATED : October 23, 2012
INVENTOR(S) : Kenneth A. Vlazny et al.

It is certified that error appears in the above-identified patent and that said Letters Patent is hereby corrected as shown below:

In the claims:

| | | | |
|---|---|---|---|
| CLAIM 4, | COLUMN 26, | LINE 24, | change “least” to --at least-- |
| CLAIM 7, | COLUMN 26, | LINE 37, | change “patron;” to --patron; and-- |
| CLAIM 7, | COLUMN 26, | LINE 50, | change “of the least” to --of the at least-- |
| CLAIM 7, | COLUMN 26, | LINE 54, | change “that,” to --than,-- |
| CLAIM 9, | COLUMN 27, | LINE 8, | change “the least” to --the at least-- |

Signed and Sealed this
Twelfth Day of March, 2013

Teresa Stanek Rea
*Acting Director of the United States Patent and Trademark Office*